US006302641B1

(12) United States Patent
Iwane et al.

(10) Patent No.: US 6,302,641 B1
(45) Date of Patent: Oct. 16, 2001

(54) MULTIPLE TYPE VACUUM PUMP

(75) Inventors: Matsumi Iwane, Nagono-Ken; Rong-Yuan Jou, Taichung, both of (JP)

(73) Assignees: Kashiyama Kougyou Industry Co., Ltd., Tokyo (JP); Precision Instrument Development Center National Science Council, Hsinchu (TW)

( * ) Notice: Subject to any disclaimer, the term of this patent is extended or adjusted under 35 U.S.C. 154(b) by 0 days.

(21) Appl. No.: 09/479,212

(22) Filed: Jan. 7, 2000

(51) Int. Cl.[7] ..... F01D 5/00; F03B 1/04
(52) U.S. Cl. ..... 415/72; 415/199.4
(58) Field of Search ..... 415/72, 73, 74, 415/75, 199.4

(56) References Cited

U.S. PATENT DOCUMENTS

| | | | | |
|---|---|---|---|---|
| 431,571 | * | 7/1890 | Fiesse | 415/74 |
| 2,910,726 | * | 11/1959 | Parshall et al. | 415/74 X |
| 2,920,347 | * | 1/1960 | Joukainen et al. | 415/74 |
| 3,277,528 | * | 10/1966 | Nikiforov | 415/74 |
| 3,420,506 | * | 1/1969 | Gurley, Jr. | 415/72 X |
| 3,713,711 | * | 1/1973 | Cronstedt | 415/72 |
| 4,197,092 | * | 4/1980 | Bretz | 415/72 |
| 4,826,393 | * | 5/1989 | Miki | 415/72 |
| 4,826,394 | * | 5/1989 | Lotz | 415/72 |
| 5,562,405 | * | 10/1996 | Ryall | 415/72 |

FOREIGN PATENT DOCUMENTS

| | | | | |
|---|---|---|---|---|
| 50-27204 | | 9/1975 | (JP) . | |
| 60-216089 | | 10/1985 | (JP) . | |
| 2-115593 | * | 4/1990 | (JP) | 415/72 |
| 4-362294 | * | 12/1992 | (JP) | 415/72 |
| 6-92799 | | 11/1994 | (JP) . | |
| 1657757 A1 | * | 6/1991 | (RU) | 415/72 |

OTHER PUBLICATIONS

"An Easy to Understand Vacuum Technology" Complied and written by the Japan Vacuum Association, Kansai Branch; Published by the Japan Vacuum Association, Kansai Branch, pp. 91–99, Published Jun. 23, 1995.

* cited by examiner

*Primary Examiner*—John E. Ryznic
(74) *Attorney, Agent, or Firm*—Armstrong, Westerman, Hattori, McLeland & Naughton, LLP

(57) ABSTRACT

A multiple-type vacuum pump has a simple construction and superior durability. The multiple-type vacuum pump has the capacity to perform air evacuation at high velocities in the low to high vacuum zone range. The multiple-type vacuum pump includes: a screw type pump air transfer portion arranged at a downstream portion of the outer surface of a rotor and has a plurality of screw threads and screw grooves with a width of 5 mm or more; a turbo-molecular type pump air transfer portion arranged at an upstream portion and has a plurality of vanes and air transfer grooves; vanes having vane widths of 3 mm or less at the upstream edge, and formed so that the downstream edge is continuous with the upstream edge of the screw threads; a downstream edge of the base of the air transfer grooves formed so as to be continuous with the upstream edge of the base of the screw grooves. The turbo-molecular type pump air transfer portion takes the air brought in from the upstream edge at the time of rotation, compresses it and transfers it to the upstream edge of the screw type pump air transfer portion.

20 Claims, 18 Drawing Sheets

FIG. 8
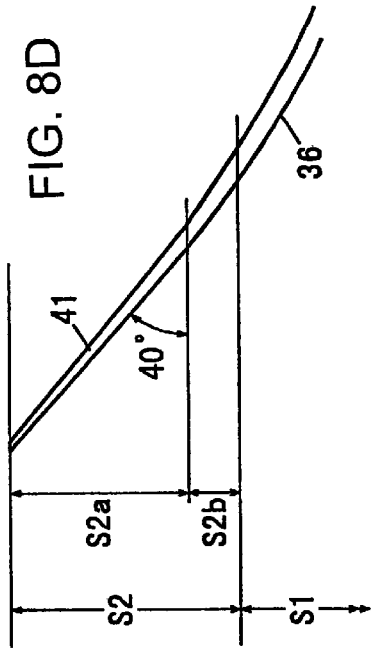
FIG. 8D
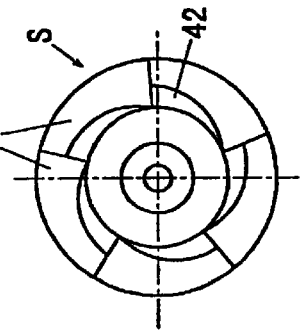
FIG. 8A
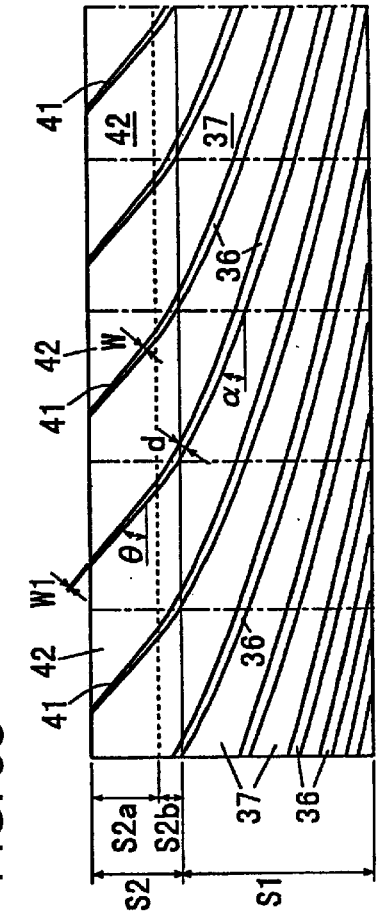
S: air transfer portion
S1: screw type pump air transfer portion
S2: turbo-molecular type pump air transfer portion
θ: vane angle α: tilt angle of screw
FIG. 8C
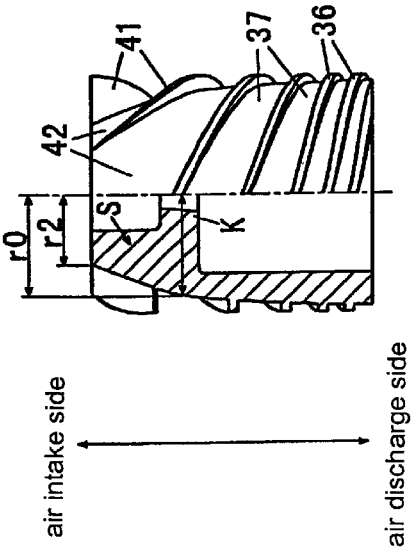
FIG. 8B FIG. 9
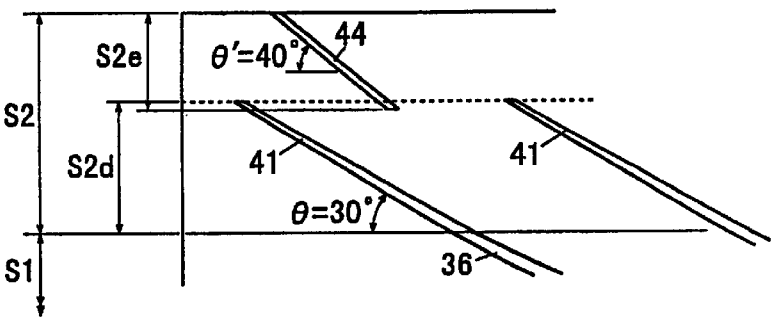
FIG. 9D
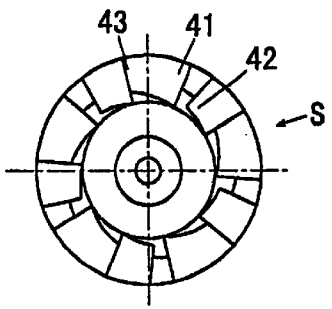
FIG. 9A
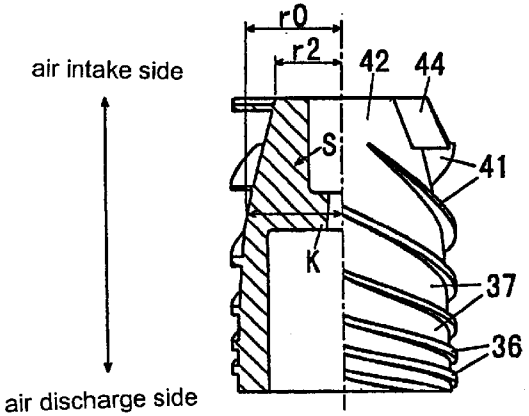
FIG. 9B
S: air transfer portion
S1: screw type pump air transfer portion
S2: turbo-molecular type pump air transfer portion
S2c: additional vane arrangement zone
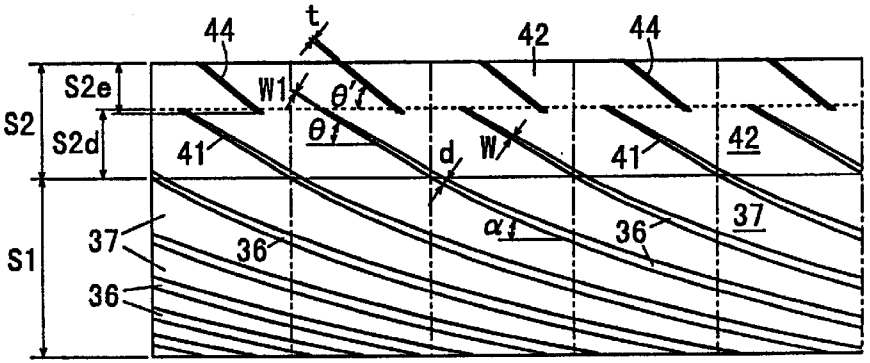
FIG. 9C

MULTIPLE TYPE VACUUM PUMP

BACKGROUND OF THE INVENTION

1. Technical Field of the Invention

The present invention relates to a vacuum pump capable of performing an ideal air removal action in pressure zones from low vacuum zones to high vacuum zones, and in particular relates to a multiple-type vacuum pump that possesses the function of a turbo-molecular pump which transfers air in high vacuum zones in a highly efficient manner, and the function of a screw type pump which transfers air in intermediary vacuum zones in a highly efficient manner.

Uses for this multiple-type vacuum pump invention include the emptying of the vacuum chamber of CVD equipment used in the manufacture of semiconductors.

2. Background Art (The Screw Type Pump)

The screw type vacuum pump is one which is well-known among the conventional vacuum pumps. For example, a known one, described in the Japanese Laid-open Publication No. Sho 60-216089, is a kind of screw type pump used from low vacuum zones, known as sliding flow zones, to high vacuum zones, known as free molecule zones, and has superior air evacuation capabilities in low vacuum zones.

In other words, screw type pumps are highly efficient in the evacuation of air in low vacuum zones and are capable of high-speed air evacuation, but experience a decrease in air intake volume and a lowered air evacuation efficiency in high vacuum zones. However, in the vacuum pumps used as air evacuation units in the CVD equipment used in the manufacture of semiconductors, they are required to possess superior air evacuation characteristics not only in low vacuum zones, but also in high vacuum zones.

(The Technology of (J01) Described in Japanese Examined Patent Publication No. Hei-6-92799)

The following is a known prior art (J01) that is described in Japanese Examined Patent Publication No. Hei-6-92799 which aims to fulfill the above-mentioned requirement.

Described in this publication is a screw type vacuum pump whose air intake volume in high vacuum zones was increased for the purpose of improving its air evacuation efficiency in high vacuum zones.

The screw type vacuum pump mentioned in this publication has a groove width correlation {groove width/(thread width+groove width)} of 0.8–0.95 in its upstream edge portion in the direction of the air conveyance, and attempts to increase the air intake volume at its upstream edge by increasing the groove depth as it goes toward the upstream edge.

(Problems Relating to the Above-mentioned Prior Art (J01))

The air evacuation efficiency of the above-mentioned prior art did not actually increase in the high vacuum zones to the degree anticipated. The reasons for this are not clear, but probable causes such as the following can be assumed:

(1) When speaking of a screw type pump which has inferior air evacuation capacity in high vacuum zones, a reason for which its air intake volume in high vacuum zones does not increase can be explained by the design for vacuum pumps which originally came from screw type pump theories relating to direction of air transfer, from the upstream edge to the downstream edge. In other words, in turbo-molecular pumps, which have a high air transfer capacity in high vacuum zones, vanes are used for air transfer that, if strong, the thinner they are, the more volume of air they can take in, and the greater the air evacuation capacity. In screw type pump theory, however, no matter how the screw grooves and screw threads of the upstream edge portion were to be designed, the air intake capacity in high vacuum zones would not increase.

(The Turbo-Molecular Pump)

In contrast to the above-mentioned screw type pumps, turbo-molecular pumps, like those disclosed in patent publications and the like, such as in Japanese Examined Patent Publication No. Sho 50-27204, have superior air transfer characteristics in high vacuum zones.

That is, turbo-molecular pumps have a casing with a cylindrical inner surface, wherein lies a rotor which rotates around the rotary shaft of the shaft of the above-mentioned casing. On the inner surface of the above-mentioned casing, multiple fixed vanes (static vanes), arranged along the circumference, are arranged in a multi-level fashion at prescribed intervals in the direction of the shaft. On the outer surface of the above-mentioned rotor, multiple dynamic vanes, arranged along the circumference, are arranged in a multi-level fashion in the direction of the shaft. The above-mentioned static vanes and dynamic vanes are slanted in relation to the above-mentioned rotary shaft, and the tilt angle (vane angle) decreases from the upstream side to the downstream side.

Each level of each of the static vanes and dynamic vanes, which are placed in multi-level fashion at intervals in the direction of the above-mentioned shaft, is placed alternately in the direction of the shaft and organized in such a way as to take the air brought from the upstream edge going in the direction of air transfer and transfer it to the downstream side by virtue of the rotation of the above-mentioned dynamic vanes.

The air evacuation efficiency of a turbo-molecular pump such as this is high in high vacuum zones, but the problem with it is that its air evacuation efficiency in low vacuum zones is low.

Another problem is the use of large numbers of static vanes and dynamic vanes, which means a large number of parts, and a construction that is complex and costly. Still another problem is the ease with which the above-mentioned static vanes and dynamic vanes become dirty.

(The Multiple-Type Vacuum Pump)

Conventionally, multiple-type vacuum pumps that are a combination of the screw type pump and the turbo-molecular pump have been known, and it was hoped that a vacuum pump would be created capable of achieving a highly efficient air evacuation rate in low to high vacuum zones by bringing together the advantages of the above-mentioned screw type and turbo-molecular pumps. The technology for such multiple-type vacuum pumps, as in the following (J02), for example, are well known in the art.

(J02) is "An Easy to Understand Vacuum Technology" (Compiled and written by the Japan Vacuum Association, Kansai Branch; Published by the Japan Vacuum Association, Kansai Branch, pg. 91~99, published Jun. 23, 1995).

This (J02) prior art relates to a multiple-type vacuum pump that combines a screw type pump with a turbo-molecular pump, by placing the turbo-molecular pump on the upstream side of the screw type pump. The air taken in by the turbo-molecular pump on the upstream side is compressed and transferred to the screw type pump on the downstream side. For this reason, the screw type pump, which performs air evacuation with low efficiency in high vacuum zones, is able to take the air which has been compressed by the turbo-molecular pump on the upstream side and transfer it to the downstream side with great efficiency.

(Problems Associated with the Aforementioned Prior Art (J02))

The foregoing prior art (J02) requires that numerous static vanes and dynamic vanes be manufactured and placed at many levels in the direction of the shaft of the turbo-molecular pump and installed at prescribed locations. This results in high manufacturing costs.

Moreover, the structure of the turbo-molecular pump portion is complex, so that when it is used in CVD equipment as an air evacuation device, or when it expels a large quantity of reactive air which has not reacted with anything, it provides many places where side reaction product can easily stick and build up. Side reaction product sticks and builds up easily on the static vanes of turbo-molecular pumps, for example. The result is a multiple-type vacuum pump whose durability may be greatly deteriorated.

The applicants of the present invention learned from the problems associated with the above-mentioned conventional multiple-type vacuum pump, and have developed the following technology (J03) which has already been on the market for some time.

((J03) Multiple-type Vacuum Pump Shown in FIG. 17 and FIG. 18)

FIG. 17 is a drawing showing the side view of the rotor of the multiple-type vacuum pump which the applicants of this invention have developed and have had on the market for some time. FIG. 18 is a cross-sectional view taken along the line XVIII—XVIII of FIG. 17 above.

The multiple-type vacuum pump 01 in FIG. 17 and FIG. 18 has a casing with a cylindrical inner surface 02*a* and a rotor 03 which rotates around a rotary shaft of the shaft of the above-mentioned cylindrical inner surface. On the outer surface of the rotor 03 is formed an air transfer portion 04 which transfers air in the direction of the shaft at the time of rotation. In the above-mentioned air transfer portion 04, a screw type pump air transfer portion 05 is provided in a downstream portion in the direction of air transfer and a turbo-molecular type pump air transfer portion 06 of the upstream portion. Between the above-mentioned screw type pump air transfer portion 05 and the turbo-molecular type air transfer portion 06, there is provided a ring connector 07 formed as ring-shaped concave grooves.

The above-mentioned screw type pump air transfer portion 05 includes multiple screw threads 05*a* which are formed as a spiral and at circumferentially prescribed intervals in the above-mentioned downstream portion of the outer surface of the above-mentioned rotor 03, and screw grooves 05*b* formed in between each of the aforementioned multiple screw threads 05*a*. The above-mentioned turbo-molecular type pump air transfer portion 06 includes multiple vanes 06*a* formed at a slant in relation to the direction of the rotary shaft and at circumferentially prescribed intervals, and air transfer grooves 06*b* formed between each of the above-mentioned multiple vanes 06*a*.

For each of the above-mentioned vanes 06*a:* the thicknesses of the upstream edge vanes are made smaller than the width of the above-mentioned screw threads 05*a,* and the downstream edge is formed as a continuation at the upstream edge of the above-mentioned screw threads 05*a*, while the downstream edge of the base of the above-mentioned air transfer grooves 06*b* is formed so as to be continuous with the upstream edge of the base of above-mentioned screw grooves 05*b*.

In the (J03) multiple vacuum pump 01, constructed as described above, air which has been taken in from the upstream edge at the time of rotation is compressed by the turbo-molecular air transfer portion 06 and transferred to the upstream edge of the above-mentioned screw type pump air transfer portion 05. Different from the ordinary turbo-molecular pump, which has static vanes and dynamic vanes arranged in a multi-level fashion and placed alternately in the direction of the shaft, the turbo-molecular type pump air transfer portion 06 has only vanes that correspond to the first-stage dynamic vanes of the upstream edges of the ordinary turbo-molecular pump. For this reason, the turbo-molecular type air transfer portion 06 has a simple construction and is easy to manufacture.

(Problems to be Solved)

The multiple vacuum pump 01 of the prior art (J03) with its capacity as such has been sold on the market for nearly thirty years. The reason why the above-mentioned (J03) multiple vacuum pump has sold for over such a long period of time is because, over a period of many years, there has been no multiple vacuum pump with a capacity of epoch-making proportions, although various efforts have been made in the vacuum pump industry to develop a new multiple vacuum pump.

In the multiple vacuum pump 01 which uses the foregoing prior art (J03), the inventors of the present invention were interested in knowing what the air flow conditions, at the ring connector 07 part formed by the aforementioned ring-type concave groove, would be like if the turbo-molecular pump air transfer portion 06 on the upstream side were connected to the screw type air flow transfer portion 05, and conducted a simulation using a supercomputer in order to find out. The results of the simulation showed a smoother air flow and improved air transfer efficiency.

Based on the results of the simulation, a multiple-type vacuum pump was made such that the downstream edges of the vanes 06*a* and the air transfer grooves 06*b* of the turbo-molecular type pump air transfer portion 06 on the upstream side were connected to the upstream edges of the screw threads 05*a* and the screw grooves 05*b* of the screw type pump air transfer portion 05 on the downstream side. When this simulation was done, it was possible to achieve, in a verifiable manner, nearly double the capacity as compared to the above-mentioned conventional multiple-type vacuum pump (J03), (i.e., the capacity to discharge air in ½ the time of the conventional multiple-type vacuum pump) .

SUMMARY OF THE INVENTION

In view of the foregoing problems and the test results of the experimental products, the following (O01) relates to the technical object of the present invention.

(O01) To provide a multiple-type vacuum pump that not only achieves a very fast air exhaust speed in the low to high vacuum zone range, but also has a simple construction and superior durability.

Described below is the present invention and how it solves the above-mentioned problems. However, in order to make it easier to correlate the constituents of the application examples below with the constituents of this invention, there is appended a list of numerical and other symbols in brackets that correspond to the constituents of the application examples. Meanwhile, correlating the symbols of the application examples that follow to the present invention was done in order to facilitate understanding of the invention, and not to limit the scope of the present invention to the embodiments set forth in the specification.

In order to resolve the above-mentioned problems, the present multiple-type vacuum pump invention was equipped with the following constructional requirements (A01)–(A04) which represent its distinct features.

(A01) A rotor (H), which rotates around rotary shaft (J) that is concentric with a casing (6) within the casing (6) that has a cylindrical inner surface and whose air transfer portion (S), which transfers air in the direction of the shaft at the time of rotation, is formed on the outer surface;

(A02) The air transfer portion (S), having a turbo-molecular type pump air transfer portion (S2) of the upstream portion in the direction of air transfer, and a screw type pump air transfer portion (S1);

(A03) The screw type pump air transfer portion (S1), which transfers, to the upstream side, air that has flowed into the upstream edge at the time of rotation, and which includes multiple screw threads (36), formed as a spiral and with a width of more than 5 mm and placed at prescribed intervals circumferentially in the downstream portion of the outer surface of the rotor (H), and screw grooves (37) formed between each of the multiple screw threads (36);

(A04) turbo-molecular type pump air transfer portion (S2), comprising multiple vanes (41) having fixed vane angles (θ) formed at prescribed intervals circumferentially in the upstream portion of the outer surface of the rotor (H) and air transfer grooves (42) formed in between each of the multiple vanes (41), where upstream edge vane widths (W1) of the vanes (41) are each formed to be 3 mm or less, while downstream edges of the vanes (41) are formed so as to be continuous with the upstream edge of the screw threads (36), a downstream edge at the base of the air transfer portion (42) formed so as to be continuous with the upstream edge of the base of the screw grooves (37), and takes air that has been brought down from the upstream edge at the time of rotation, compresses it and then transfers it to the upstream edge of the screw type pump air transfer portion (S1).

(Description of the Constructional Requirements of the Invention)

In the present invention described above, the above-mentioned "turbo-molecular type pump air transfer portion (S2)" refers to the member equipped with the following constructional requirements (A04):

(A04) "Turbo-molecular type pump air transfer portion (S2)", comprises air transfer grooves (42) formed between multiple vanes (41) having fixed vane angles (θ) formed at prescribed intervals circumferentially in the upstream portion of the outer surface of the rotor (H) and each of the multiple vanes (41), the vanes (41) whose upstream edge vane widths (W1) are each formed to be 3 mm or less and whose downstream edge is formed so as to be continuous with the upstream edge of the screw threads (36), where a downstream edge at the base of the air transfer portion (42) is formed so as to be continuous with the upstream edge of the base of the screw grooves (37), and takes air that has been brought down from the upstream edge at the time of rotation, compresses it and then transfers it to the upstream edge of the screw type pump air transfer portion (S1).

The constructional requirements (A04) of the above-mentioned turbo-molecular type pump air transfer portion (S2) differ from the constructional requirements of ordinary turbo-molecular pumps. One of the differences, for example, is that while the thickness of the dynamic vanes in the upstream edge portion in ordinary turbo-molecular pumps is uniform at both the upstream and downstream edges, the vanes (41) of the turbo-molecular type pump air transfer portion (S2), according to the present invention, are of varied thicknesses at the upstream and downstream edges.

In the detailed description of this case, the term turbo-molecular type pump air transfer portion (S2) is used relating to the above-mentioned constructional requirements (A04) which differ from the constructional requirements of the above-mentioned turbo-molecular pump. This is because, one can use turbo-molecular design theory, as described below, to make a broad range of designs.

Notwithstanding, it is not necessary to use turbo-molecular pump design theory when designing the above-mentioned turbo-molecular type pump air transfer portion (S2). For instance, as disclosed in the screw type pump of Japanese Examined Patent Publication No. Hei-6-92799, it would also be possible to design a turbo-molecular type air transfer portion (S2) equipped with the above-mentioned constructional requirements (A04) by making the screw threads of the upstream portion narrower as they go to the upstream side.

The detailed description in the present application uses the term "turbo-molecular type pump air transfer portion (S2)" in reference to the member that has the constructional requirements (A04), and therein explains the design methods following turbo-molecular pump design theory, but this is in no way meant to place limitations on the construction of the conventional turbo-molecular pumps.

The vanes (41) of the turbo-molecular type pump air transfer portion (S2) are members comprised of the dynamic vanes of the upstream edge portion of ordinary turbo-molecular pumps (e.g. first- or second-stage dynamic vanes), and have the same function as these dynamic vanes (the function whereby air is taken, compressed and transferred downwardly). Additionally, the vanes (41) of the turbo-molecular type pump air transfer portion (S2) are similar in form to the dynamic vanes of the upstream edge portion of ordinary turbo-molecular pumps. Furthermore, with regard to the approximate values of air evacuation volume, air compression ratio, etc., in the turbo-molecular pump type air transfer portion (S2) of the present invention, it is possible to calculate approximate values from the contour parameters of the turbo-molecular pump air transfer portion (S2) by using ordinary turbo-molecular pump design theory.

The vanes (41) of the turbo-molecular type pump air transfer portion (S2) correspond to the dynamic vanes of the upstream edge portion in ordinary turbo-molecular pumps (e.g. the first- and second-stage dynamic vanes), and the same function is demanded of them as those of the foregoing dynamic vanes of the upstream edge portion. In other words, the spacing chord ratio (So/b), determined by the spacing So and length b between each of the multiple vanes (41), is set within the range of $0.8 \leqq (So/b) \leqq 1.2$, the same as for the dynamic vanes (e.g. the first- and second-stage dynamic vanes) of the upstream edge portion of the turbo-molecular pump. Furthermore, the thinner the vanes (41) of the turbo-molecular type pump air transfer portion (S2) are, the larger the square measure of the opening is, so it is desirable to make them thinner, in the same fashion as in the dynamic vanes of the upstream edge portion of the foregoing ordinary turbo-molecular pump, so long as the strength can be maintained. Further, the vanes (41) have an overall plate shape, but it is possible to add somewhat of a twist to the vanes (41), or to provide them with a little curved or bent portion in the upstream or downstream edge portions. Particularly in the case where the vane angle (θ) of the vanes (41) and the tilt angle of the screw α 1 of the upstream edge of the screw type pump air transfer portion (S1) are θ>α 1, it is desirable to provide a little curved portion in the downstream edge portion of vanes (41) for the purpose of making smooth the connection between the downstream edge of the vanes (41) and the upstream edge of screw threads (36).

In addition, it is possible to provide the turbo-molecular type pump air transfer portion (S2) with additional vanes (43, 44) other than each of the multiple vanes (41) formed so as to connect the downstream edge with the upstream edge of the screw threads (36). The additional vanes (43, 44) can be disposed between each of the adjacent vanes (41) spaced from each other circumferentially, or disposed at the upstream side of each of the vanes (41).

During the normal rotation of the multiple-type pump (P), according to the present invention, it is desirable to design such that the air transfer volume (cubical flow volume, air evacuation volume) at the downstream edge of the turbo-molecular type pump air transfer portion (S2) be equal to the air transfer volume (cubical flow volume, air intake flow volume) of the upstream edge of the screw type pump air transfer portion (S1) of its downstream side. In that case, it is possible to calculate the air evacuation volume of the turbo-molecular type pump air transfer portion (S2) of the present multiple-type pump invention (P) using the same calculation methods used to determine the air transfer volume of the dynamic vanes in the upstream edge portion in ordinary turbo-molecular pumps.

It is, therefore, possible to design the turbo-molecular type pump air transfer portion (S2) whose air transfer volume (cubical flow volume and air evacuation volume) in its downstream edge is equal to the air transfer volume of the upstream edge of the screw pump type air transfer portion (S1).

Moreover, at the time of design development, it is possible to, for example, design the vanes (41), if it has a little curved portion at its upstream or downstream edge portions, to be a flat plate without regard to the curved portion. And if unsuccessful in achieving a trial product with the capacity anticipated, it would be possible to modify the design according to the results of computer simulation, testing, and experimentation, and the like, to develop a high capacity product.

In high vacuum zones, known as molecular flow zones, the occurrence of air molecules colliding into one another is infrequent. Rather, it is the frequency of collision of the air molecules against the walls surrounding them that governs the movement of the air molecules. For this reason, in order to improve a pump's air evacuation capacity, within the range of a pressure zone (a high vacuum zone), the important factor is what degree of efficiency the air molecules fed into the pump's air intake opening can be transferred out to the air outlet. Since the volume of in-coming air molecules is proportionate to the square area of the air intake opening, enlarging the square area of the air intake opening is a useful means for increasing air evacuation velocity. Nevertheless, enlarging, without care, the square area of the opening increases in-coming air molecules, which, in turn, increase the return of air molecules, with the result that the air evacuation velocity cannot be increased, thereby degrading compression capacity. For this reason, to achieve the targeted air evacuation speed, it is advantageous to utilize the above-mentioned theoretically established turbo-molecular pump design methods in regard to air evacuation efficiency and compression capacity, in order to establish the appropriate square area of the opening while maintaining a steady level of air evacuation efficiency and compression capacity. It is advisable that the surface of the connector portion of the downstream edge of the turbo-molecular type pump air transfer portion (S2), and the upstream edge of the screw type pump air transfer portion (S1) be joined together in a smooth manner.

When, for example, a base diameter, a diameter of a circle that includes a circumference of the base (the connector portion where vane (41) joins the air transfer grooves(42)) of the vanes (41) that lie in a cross-sectional plane perpendicular to the rotary shaft (J), and to the base of the screw threads (36) (the connector portion where screw thread (36) joins the screw grooves (37)) is small at the upstream edge and large at the downstream edge of air transfer portion (S), it is favorable that the base diameter be changed, along the axial direction, in a smooth manner. By doing this, the radiuses from the center of the rotary shaft (J) are the same, allowing for a smooth connection between the base of the downstream edge of air transfer grooves (42) of the turbo-molecular type pump air transfer portion (S2), and the base of the upstream edge of screw grooves (37) of the screw type pump air transfer portion (S1).

In addition, since the vanes (41), having a thickness of 3 mm or less at the upstream edge of the turbo-molecular type pump air transfer portion (S2), need to be made the same thickness, at the downstream edge, as the width of the screw threads (36), the thickness of the vanes (41) is increased as they progress toward the downstream side. Thus, a smooth connection can be created between the downstream edge of the vanes (41) and the upstream edge of the screw threads (36), which is favorable. In this case, the thickness of the downstream edge of the vanes (41) is equal to the width of the upstream edge of the screw threads (36), and the width of the downstream edge of the air transfer grooves (42) is equal to the upstream edge of the screw grooves (37).

In doing this, it is possible to avert the harmful effects on a lowering of air evacuation efficiency arising from a disturbance in the flow of air due to abrupt changes in the shape between the turbo-molecular type pump air transfer portion (S2) and the screw type pump air transfer portion (S1).

Further, in the present invention, it is also possible to dispose a turbo-molecular pump (50) having multiple dynamic vanes (51*a*, 52*a*) and static vanes (53*a*, 54*a*), located at the further upstream side of the upstream edge of the turbo-molecular type pump air transfer portion (S2) and arranged in an alternate fashion in the direction of air transfer. In that case, it is possible to improve the air evacuation capacity in an ultra-high vacuum zone of the multiple-type vacuum pump (P).

(Operation of the Invention)

The rotor (H) of a multiple-type vacuum pump, equipped with the above-mentioned construction, according to this invention, rotates within the casing (6) having a cylindrical inner surface, and around the rotary shaft (J) coaxial with the casing (6). The air transfer portion (S) formed on the outer surface of the rotary (J), has the turbo-molecular type pump air transfer portion (S2) of the upstream portion of the air transfer direction, and the screw type pump air transfer portion (S1) of the downstream portion.

The turbo-molecular type pump air transfer portion (S2) has multiple vanes (41), which are arranged circumferentially at prescribed intervals in the upstream portion of the rotor (H) and have prescribed vane angles (θ), and air transfer grooves (42), which are formed between each of the multiple vanes (41). Since each of the vanes (41) are made with a vane thickness (W1) of 3 mm or less in the upstream edge, the square area of the upstream edge opening becomes large, thereby taking in a larger air volume. The turbo-molecular type pump air transfer portion (S2) takes air that has been drawn in from the upstream edge at the time of rotation, compresses it and transfers it to the upstream edge of the screw type pump air transfer portion (S1).

Thus, the turbo-molecular type pump air transfer portion (S2), like ordinary turbo-molecular pumps, can transfer air in high vacuum zones in a very efficient manner.

The downstream edge of the vanes (41) of the turbo-molecular type pump air transfer portion (S2) is connected to the upstream edge of the screw threads (36). In addition, the downstream edge of the base of the air transfer groove (42) is connected to the upstream edge of the base of the screw grooves (37). With this structure, the air being transferred to the downstream side, through the air transfer grooves (42) of the turbo-molecular type pump air transfer portion (S2), can pass through the connector portion of the downstream edge of the air transfer grooves (42) and the upstream edge of the screw grooves (37) without any significant disturbances.

Therefore, the air that has been transferred from the turbo-molecular type pump air transfer portion (S2) is able to flow into the screw type pump air transfer portion (S1) in a compressed state and without being accompanied by a significant reduction in speed or rise of pressure at the upstream edge of the screw type pump air transfer portion (S1).

The screw type pump air transfer portion (S1) has multiple screw threads (36), spiral in shape, and formed circumferentially at prescribed intervals at the downstream portion of the outer surface of the rotor (H), and screw grooves (37) formed between each of the multiple screw threads (36), and transfers the drawn-in air to the downstream side at the time of rotation. Since the screw threads (36) have a width of 5 mm or more, they are able to prevent air that is being transferred to the downstream side from reversely passing over screw threads (36) from the downstream screw grooves (37) to the upstream side.

Air (high-density air), compressed by the turbo-molecular type pump air transfer portion (S2) disposed at the upstream side of the screw type air transfer portion (S1), flows into the upstream edge of the screw type transfer portion (S1), so that the screw type pump air transfer portion (S1) is able to perform air transfer under the same conditions as when it transfers air in low vacuum zones (high air density zones). The screw type pump air transfer portion (S1) has the same air evacuation capacity in low vacuum zones as ordinary screw type pumps, and is, thus, capable of exhausting the air (having an enhanced density) which has been drawn in from the turbo-molecular type air transfer portion (S2) in a compressed state, in a very efficient manner.

As described above, in the multiple-type vacuum pump invention (P), according to the present invention, the turbo-molecular type pump air transfer portion (S2) is disposed at the upstream side (air intake opening side) portion of the screw type pump air transfer portion (S1) formed on the outer circumferential surface of rotor (H), where the air intake and evacuation volumes can be estimated, based on turbo-molecular design theory.

It is, therefore, possible to increase air evacuation velocity by enlarging the square area of the opening at the air intake side to a great extent in the free molecule zone, without degrading the compression capacity. For this reason, a multiple-type vacuum pump can be realized in which a great air evacuation velocity can be attained at a wide range of pressure from low to high vacuum zones.

BRIEF DESCRIPTION OF THE DRAWINGS

FIG. 3 is a drawing showing the rotor shown in FIG. 1 above, wherein FIG. 3A is a drawing of the rotor viewed from the upstream side in the direction of air transfer; FIG. 3B is the side view of the rotor; FIG. 3C is an expanded drawing of the outer surface of the rotor; and FIG. 3D is drawing which magnifies the essential elements in FIG. 3C.

FIG. 5 is a drawing showing the rotor in a second embodiment of the present multiple-type vacuum pump invention, which corresponds to the first embodiment in FIG. 3, wherein FIG. 5A is a drawing of the rotor viewed from the upstream side of the direction of air transfer; FIG.5B is side view of the rotor; FIG. 5C is an expanded drawing of the outer surface of the rotor; and FIG. 5D is a drawing which magnifies the essential elements of FIG. 5C above.

FIG. 6 is a drawing showing the rotor of the multiple-type vacuum pump, according to a third embodiment of the present invention, which corresponds to the second embodiment in FIG. 5, wherein FIG. 6A is a drawing of the rotor viewed from the upstream side of the direction of air transfer; FIG. 6B is side view of the rotor; FIG. 6C is an expanded drawing of the outer surface of the rotor; and FIG. 6D is a drawing which magnifies the essential elements of FIG. 6C above.

FIG. 7 is a drawing showing the rotor of the multiple-type vacuum pump, according to a fourth embodiment of the present invention, which corresponds to the second embodiment in FIG. 5, wherein FIG. 7A is a drawing of the rotor viewed from the upstream side of the direction of air transfer; FIG. 7B is side view of the rotor; FIG. 7C is an expanded drawing of the outer surface of the rotor; and FIG. 7D is a drawing which magnifies the essential elements of FIG. 7C above.

FIG. 8 is a drawing showing the rotor of the multiple-type vacuum pump, according to a fifth embodiment of the present invention, which corresponds to the first embodiment in FIG. 3 above, wherein FIG. 8A is a drawing of the rotor viewed from the upstream side of the direction of air transfer; FIG. 8B is side view of the rotor; FIG. 8C is an expanded drawing of the outer surface of the rotor; and FIG. 8D is a drawing which magnifies the essential elements of FIG. 8C above.

FIG. 9 is a drawing showing the rotor of the multiple-type vacuum pump, according to a sixth embodiment of the present invention, which corresponds to the fifth embodiment in FIG. 8 above; wherein FIG. 9A is a drawing of the rotor viewed from the upstream side of the direction of air transfer; FIG. 9B is side view of the rotor; FIG. 9C is an expanded drawing of the outer surface of the rotor; and FIG. 9D is a drawing which magnifies the essential elements of FIG. 9C above.

FIG. 16 is a drawing showing the rotor shown in FIG. 15, wherein FIG. 16A is a drawing of the rotor viewed from the upstream side of the direction of air transfer; FIG. 16B is side view of the rotor; FIG. 16C is an expanded drawing of the outer surface of the rotor; and FIG. 16D is a drawing which magnifies the essential elements of FIG. 16C.

DETAILED DESCRIPTION OF THE PREFERRED EMBODIMENTS OF THE INVENTION

Various examples (preferred embodiments) of the present invention will be explained hereinafter with reference to the drawings. The scope of the present invention, however, is not limited to the following preferred embodiments.

(Embodiment 1)

Figure 1:
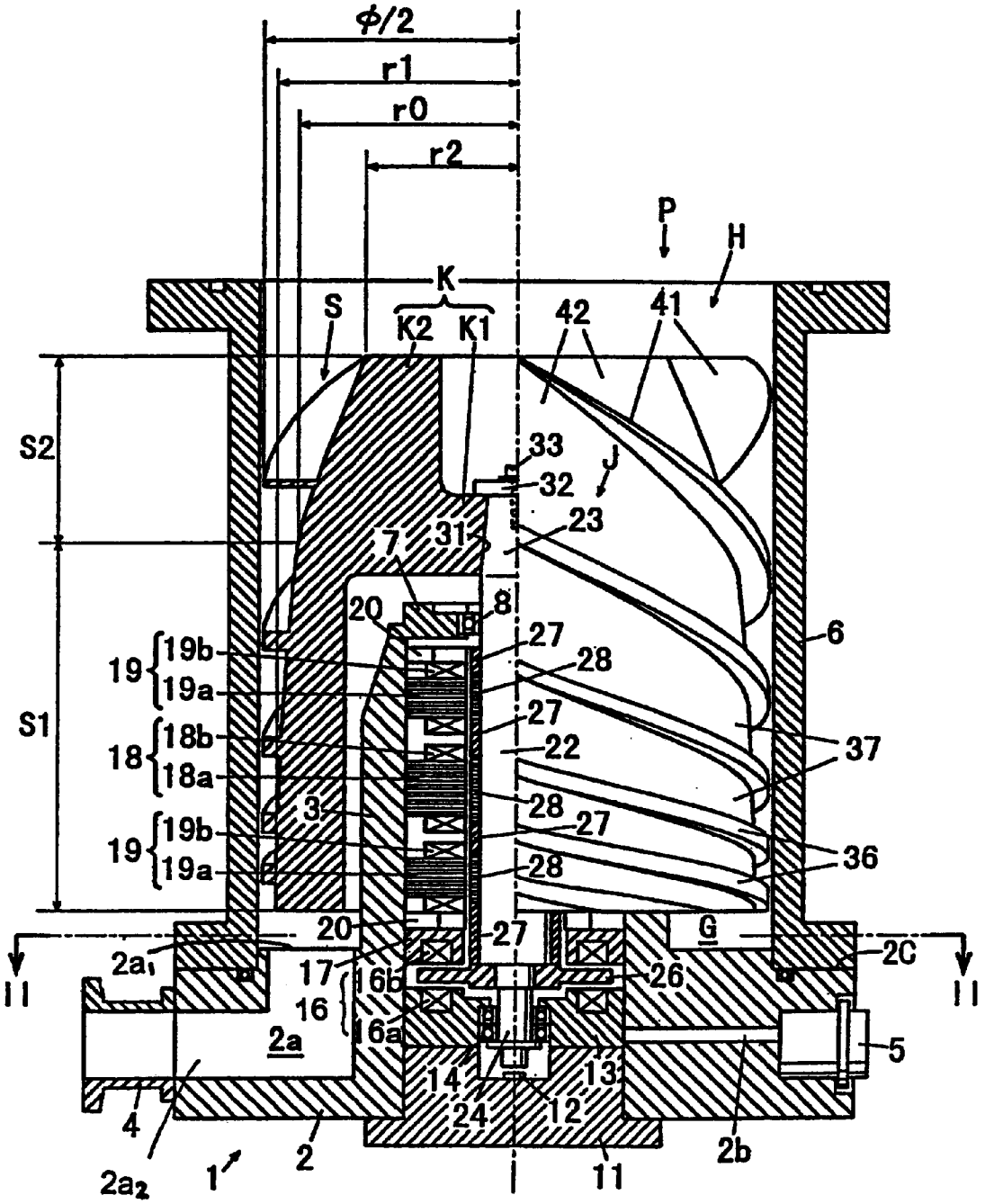
FIG. 1 is a vertical cross-sectional view of a first embodiment of the multiple-type vacuum pump according to the present invention.
Figure 2:
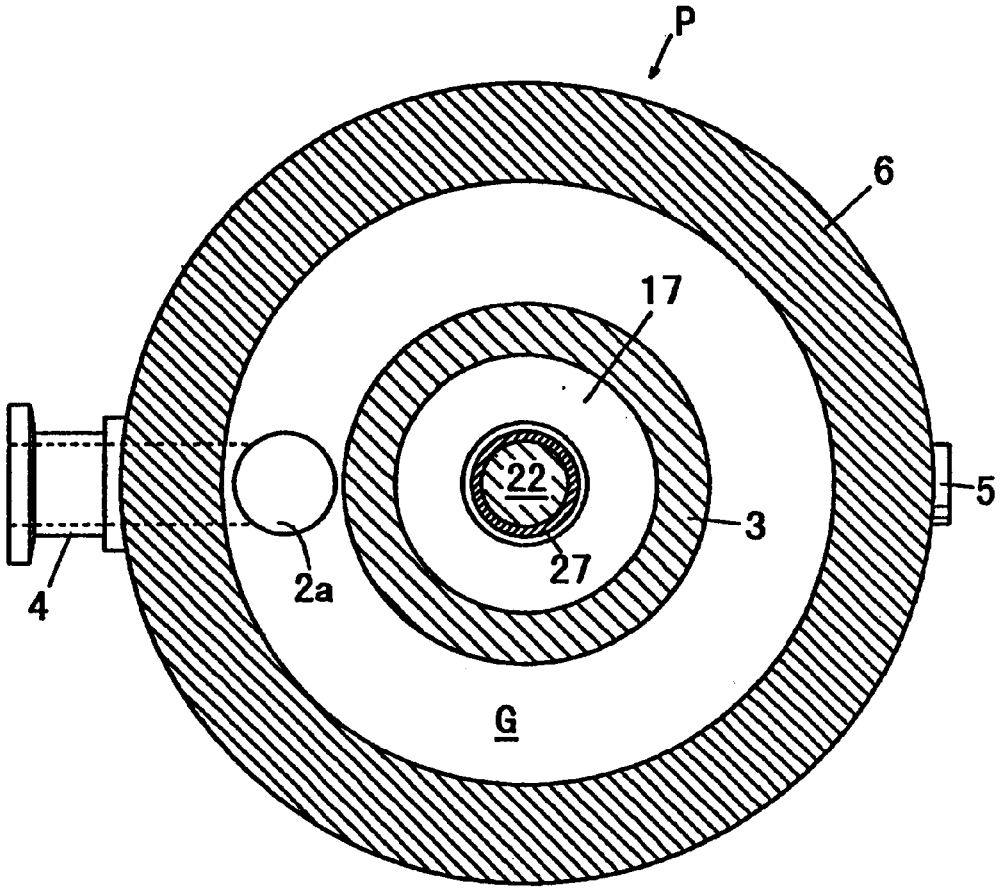
FIG. 2 is a cross-sectional view of FIG. 1 along the line II—II, illustrating the path of air evacuation in the first embodiment.

FIG. 1 is a vertical cross-sectional view of a first embodiment of a multiple-type vacuum pump, according to the present invention. FIG. 2 is a cross-sectional view of FIG. 1 along the line II—II, illustrating the path of air evacuation in the same embodiment.

In FIG. 1, a multiple-type vacuum pump P includes a base 1. The base 1 has a cylindrical bearing support member 3 which protrudes upward from the middle section of a flange 2. Formed within flange 2 is an air outlet 2*a,* an electricity supply cable insert hole 2*b* and a casing support surface 2*c*. The air outlet 2*a* has a downstream side air outlet $2a_1$, which extends in the direction of a shaft of the cylindrical bearing support member 3, and a downstream side air outlet $2a_2$, which extends in a radial direction of the shaft. An exhaust pipe connecting member 4 is connected to an outer edge of the downstream side air outlet $2a_2$, and a connector 5 is connected to an outer edge of the electricity supply cable insert hole 2*b*.

A cylindrical casing 6 is fixed to the casing support surface 2*c*. An upper bearing 8 is supported by the upper edge of the cylindrical bearing support member 3 via an upper bearing support member 7. A thrust displacement sensor 12 is supported by a lower edge of the cylindrical bearing support member 3 via a thrust displacement sensor 11. A lower bearing support member 13 is supported by an upper surface of the thrust displacement sensor support member 11, and a lower bearing 14 is supported by the lower bearing support member 13. A thrust magnetic bearing lower portion 16*a* is supported by an upper surface of the lower bearing support member 13.

An upper bearing support member 17, which supports a thrust magnetic bearing upper portion 16*b,* is supported on an inner surface of the cylindrical bearing support member 3 located above the lower bearing support member 13 with a certain spacing therefrom.

A thrust magnetic bearing 16 is made up of the thrust magnetic bearing lower portion 16*a* and the thrust magnetic bearing upper portion 16*b*.

A magnetic generation member for a motor 18 is mounted on the inner surface of the cylindrical bearing support member 3 at a middle vertical portion thereof. The magnetic generation member for the motor 18 is comprised of four electromagnets 18*a* and 18*b* which have four iron cores 18*a* disposed circumferentially at equal intervals and coils 18*b* which are wrapped around the circumference of each of the four iron cores 18*a,* and generate a rotative magnetic field and causes a rotor H to rotate, as mentioned below.

A pair of radial magnetic bearings 19 are mounted on the cylindrical bearing support member 3 by upper and lower portions of the magnetic generation member for a motor 18. The radial magnetic bearings 19, 19 are comprised of four electromagnets 18*a* and 18*b* which have four iron cores 19*a* disposed circumferentially at equal intervals and coils 19*b* which are wrapped around the circumference of each of the iron cores 19*a.* By virtue of magnetic force, radial magnetic bearings 19 control a radial position of the rotor H vis-a-vis the rotary shaft.

Radial displacement sensors 20, 20 are mounted at an upper side of the upper radial magnetic bearing 19 and at a lower side of the lower radial magnetic bearing 19, respectively. The magnetic force of the radial magnetic bearings 19 is controlled, by the detection signal of radial displacement sensors 20, such that the rotor H rotates at a predetermined position. Such control of the rotary position of the rotor is well known, and a variety of conventional art can be used for the application of this embodiment as well.

The rotor H is disposed inside of an inner circumferential surface of the cylinder of the casing 6. The rotor H has a shaft J and an air transfer member K. The air transfer member K has a disc-shaped shaft connecting portion K1, which is connected to the shaft J, and a cylinder portion K2, which is formed integrally with the shaft connecting portion K1.

The shaft J has a larger diameter portion 22, a tapered portion 23, which is located at an upper edge portion of the shaft J and the outer diameter of which grows smaller as it goes toward its upper edge, and a smaller diameter portion 24, which is located at the lower edge portion of the shaft J. The upper edge portion of the larger diameter portion 22 is rotatably supported by the upper bearing 8. The smaller diameter portion 24 is rotatably supported by the lower bearing 14. A circular plate 26, made from magnetic material, is supported by the upper edge portion of the smaller diameter portion 24. This circular plate 26 is disposed within a space between the lower portion 16*a* and the upper portion 16*b* of the thrust magnetic bearing 16. Stainless cylinder members 27 and steel (magnetic material) cylinder members 28 are installed alternately on the outer circumference of the larger diameter portion 22 in the direction of the shaft. Each of the multiple steel cylinder members 28 is placed at a location facing the iron cores 18*a,* 19*a*.

The shaft J is thus constructed with the elements indicated by the reference numericals 23–28.

A shaft insertion hole 31, whose inner diameter grows smaller as it progresses toward its upper edge, is formed in the central portion of the disc-shaped shaft connector K, and the tapered portion 23 of the shaft J is inserted into the shaft insertion hole 31. A connecting plate 32 is mounted onto an upper surface of the shaft connector portion K. A connecting bolt 33 passes through the connecting plate 32 from above and is screwed into an upper edge screw hole of the shaft J. Since the tapered portion 23 of the shaft J, through the connecting bolt 33, presses against the shaft insertion hole 31 of the shaft connector K, the shaft connector K and the upper edge of shaft J are connected.

A ring-shaped air outlet space G, as seen from the rotary shaft of rotor H, is formed between the lower edge of the rotor H and the flange 2, and communicates with the upstream edge of the air outlet hole upstream portion $2a_1$, formed at the flange 2.

Figure 3:
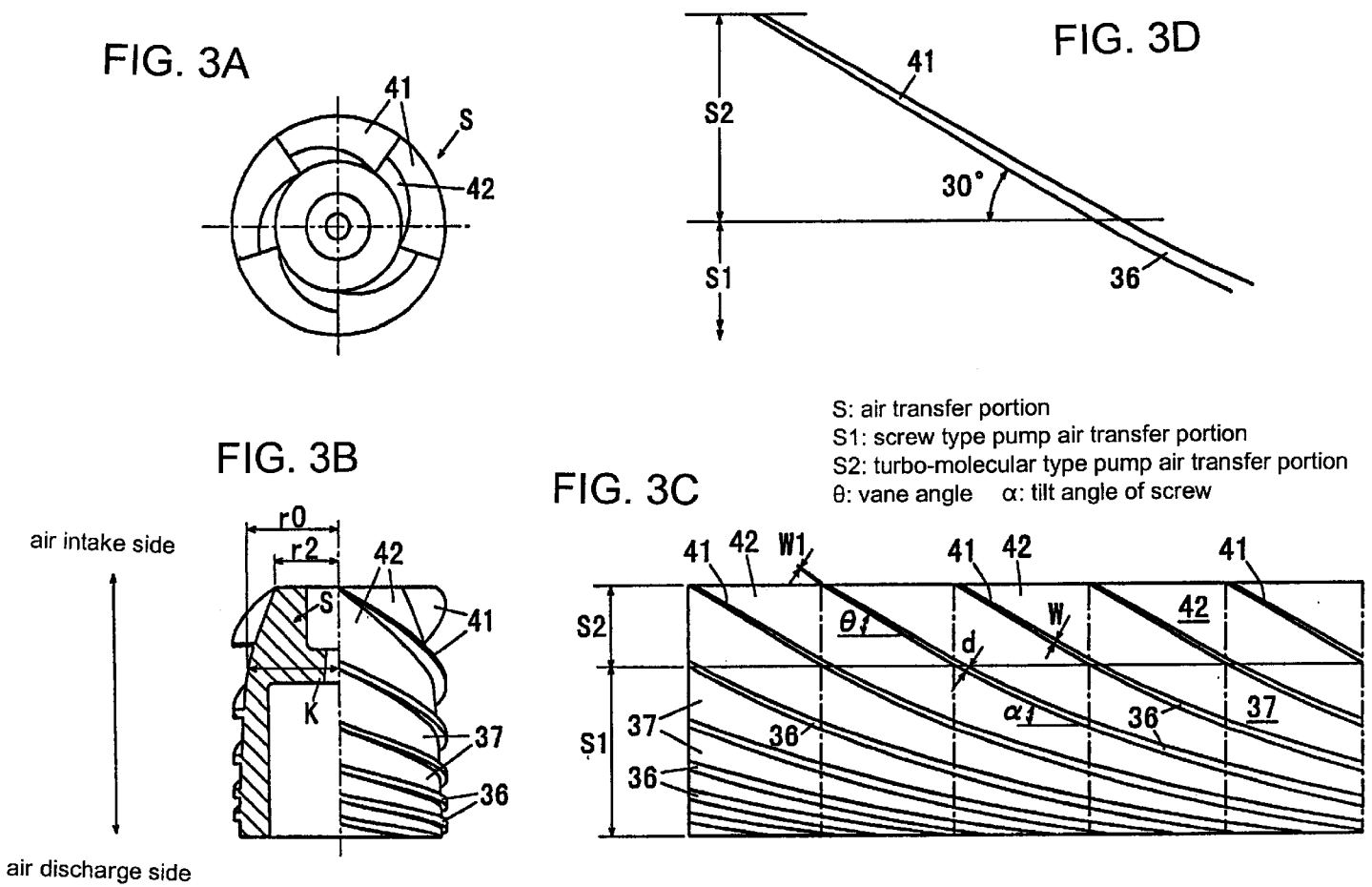

FIG. 3 is a drawing showing the rotor shown in FIG. 1. FIG. 3A is a drawing of the rotor viewed from the upstream side in the direction of air transfer; FIG. 3B is the side view of the rotor, FIG. 3C is an expanded drawing of the outer surface of the rotor; and FIG. 3D is drawing which magnifies the essential elements in FIG. 3C.

In FIG. 1 and FIG.3, an air transfer portion S is formed at the outer surface of the air transfer member K. The air transfer portion S has a screw type pump air transfer portion S1 on a downstream side thereof in the air transfer direction, and a turbo-molecular type pump air transfer portion S2 on a downstream side thereof.

The screw type pump air transfer portion S1 has multiple screw threads 36 which have set widths, are spiral in shape and are formed toward the circumference at prescribed intervals, and screw grooves 37 which are formed between each of the screw threads 36. The screw type pump air transfer portion S1 takes in the air from the upstream edge at the time of rotation, and transfers it to the downstream side.

The turbo-molecular type pump air transfer portion S2 has multiple vanes 41, which are disposed at the circumference at prescribed intervals in the upstream portion of the outer surface of the rotor H, which are tilted in the axial direction of the rotary shaft J, and air transfer grooves 42, which are formed in between each of the multiple vanes 41. A vane angle of the vane 41 is $\theta$=30° which equals a tilt angle of screw $\alpha$ (=30°) of the upper edge of the screw type pump air transfer portion S1. A vane width W1 of the upstream edge of the vane 41 is 2 mm, the width of which gets wider as it goes downstream in order for the downstream edge of the vane 41 to be smoothly connected to the upstream edge of the screw threads 36. The vane width of the downstream edge (the connecting portion of screw threads 36) of the vane 41 equals the thread width d of the screw threads 36; d=5.65.

Furthermore, the downstream edge of the base of the air transfer grooves 42 is formed as to be smoothly connected to the upstream edge of the base of the screw grooves 37. The turbo-molecular type pump air transfer portion S2 takes the air that has been brought in from the upstream edge of the rotor H at the time of rotation, and compresses it and then transfers it to the upstream edge of the screw type pump air transfer portion S1. The following section explains the meaning of $\phi$, r, r 0~r 2 that appear in FIG. 1 and refers to the measurements of the rotary shaft (J).

$\phi$: Outer diameter of the rotary shaft (J).

r: Radius of a circle touching the base (a connecting portion of the vanes 41 and the air transfer grooves 42) or that of the base of the screw threads 36 (a connecting portion of the screw threads 36 and screw grooves 37), within a cross-section perpendicular to the axial direction of the rotary shaft J.

r 0: Base radius of the bases of either the upstream edge of the screw type pump air transfer portion S1 or the downstream edge of the turbo-molecular type pump air transfer portion.

r 1: Base radius of the downstream edge of the screw type pump air transfer portion S1.

r 2: Base radius of the upstream edge of the turbo-molecular type air transfer portion.

The base radius r 0 of the upstream edge of the screw type air transfer portion S1 and the base radius r 0 of the downstream edge of the turbo-molecular type air transfer portion, have the same value. For this reason, the bottom of the downstream edge of the air transfer grooves 42 of the turbo-molecular type air transfer portion S2 run smoothly together with the base of the upstream edge of screw grooves 37 of the screw type pump air transfer portion S1. Further, the base diameter (2×base radius r), which is the diameter of the circle that is in contact with the base of the vanes 41 in the cross-section which is perpendicular to the axial direction of the rotary shaft J, is formed as to be on top of a conical plane whose outer diameter gets smaller as it makes its way up to its upstream side. For this reason, the air transfer grooves 42 of the turbo-molecular type air transfer portion S2 become deeper lineally as they make their way upstream.

In the multiple-type vacuum pump P, according to the first embodiment of the present invention, described above, when there is a big difference between the cubical flow volume (air intake volume) of the upstream edge of the screw type pump air intake portion S1 and the cubical flow volume (air exhaust volume) at the downstream edge of the turbo-molecular air transfer portion S2, the system as a whole could experience a decrease in air exhaust performance. The downstream edge of the turbo-molecular type pump air transfer portion S2 and the upstream edge of screw type pump air transfer portion S1 are, therefore, constructed in such a way that their cubical flow volumes are identical. It is possible to apply the screw type pump design theory to the design of the screw type pump air transfer portion S1, and, in the same manner, to apply the turbo-molecular pump design theory to the design of turbo-molecular type pump air transfer portion S2.

Using the screw type pump and the turbo-molecular pump design theories makes it easy to design the multiple-type vacuum pump P in which the cubical flow volume of the downstream edge of the turbo-molecular type air transfer portion S2 equals that of the upstream edge of the screw type pump air transfer portion S1.

The following procedure, for example, can be used when designing the multiple-type vacuum pump using the screw type pump and turbo-molecular pump design theories.

(Example of Design Method)

First, one establishes standard shape parameters which will serve as the design standards for the screw type pump air transfer portion S1. Once the aforementioned standard shape parameters are established, other shape parameters can be established using the same procedure as used in ordinary screw type pump design methods. For example, the aspect ratio (a/e) at the upstream edge (air intake edge) of the screw type pump air transfer portion S1 is set at 3 or more, the groove width ratio (a/a+d) is set at approximately 0.9, and the screw tilt angle $\alpha$ is set, as appropriate, within the 30°~40° range.

In other words, the initial values of the above-mentioned standard shape parameters are established, for example, as follows: while other shape parameters are adjusted and determined on the basis of the initial values, adjustments can also be made to the initial values of standard shape parameters. Further, adjustments to the other shape parameters result in changes to the standard shape parameters, as well. For example, even if the initial value of intake volume (cubical flow volume) (V) were to be V=300 L/s (liters/sec), once one reaches the stage where groove width and the groove width ratio are determined in concrete terms, the aforementioned value of (V) will change.

(1) r 0=(174/2) mm=87 mm r 0: the base radius of the upstream edge of the screw type pump air flow portion S1

(2) the intake flow volume (cubical flow volume) (V): V=300 L/s (liters/sec)

(3) the diameter of the rotor (H) (rotor diameter) $\phi$=200 mm (4) aspect ratio (a/e) at the cross-section of the groove=4.0

(a: groove width at the cross-section of the groove; e: groove depth measured from the inner surface of the casing, i.e., the distance between the inner surface of the casing and the base of the grooves 37)

(5) groove width ratio (a/a+d)=0.91

(a: groove width at the cross section of the groove; d: thread width at the cross section of the groove)

(6) upstream edge tilt angle of screw $\alpha$ 1=30°

($\alpha$ 1=the tilt angle of screw of the upstream edge of the screw type pump air transfer portion S1)

(7) clearance coefficient $\beta$ (=e/$\delta$)=23

(e: the groove depth measured from the inner surface of the casing; $\delta$: radial clearance, i.e., the distance between the inner surface of the casing and the surface of the screw threads;

e=$\delta$+b, b=groove depth)

(8) Number of rotations N=24,000 rpm

Once the above-mentioned standard shape parameter values are set, the other shape parameters of screw type pump air transfer portion S1 (inner diameter of the casing, screw thread width (d=5.65 mm), groove depth, groove width ratio, and the like) are set on the basis of screw type pump design theory. When undertaking this, the groove width ratio gets smaller as it goes toward the downstream side in the direction of air transfer, and is as much as 0.5~0.6 at the downstream edge. Also determined are the tilt angle of screw $\alpha$, which gets smaller as it makes its way to the downstream side, as well as the optimum depth, width, and the number of screw threads, etc. for the screw groove.

The following parameters are set for this embodiment:

(11) Number of screw threads=5

(12) groove width a=57.18 mm

(13) thread width d=5.65 mm

(14) groove depth e=14.29 mm

(15) square opening area of the screw groove portion=41 $cm^2$

(16) the inner diameter of the casing 6=201.24 mm (Based on the above-mentioned (7), $\delta$=(e/23)=(14.29/23)=0.62 (=radial clearance), inner diameter of the casing=diameter of the rotor H (rotor diameter)+0.62×2=200+1.24=201.24 mm)

(17) The designed air intake velocity V as the screw type pump=282 L/s (liters/sec).

When the shape parameters are set, the air intake velocity (V) is expressed as follows:

Air intake velocity=groove width $a$×groove depth $e$×$\pi$×number of rotations $N$×number of grooves 5×diameter $r$ 0×pump efficiency/2

It is noted that the pump efficiency is determined by the relationship to geometric shape, circumferential velocity and clearance, etc.

Next is determined the necessary standard shape parameters for the design of the turbo-molecular type pump air transfer portion S2. The constructional elements (the vanes 41, the air transfer grooves 42, etc.) of the turbo-molecular type pump air transfer portion S2, according to the example 1, are members which have the same air intake function as dynamic vanes at the upstream edge (first-stage) of ordinary turbo-molecular pumps. The standard shape parameter values for the constructional elements (the vanes 41, the air transfer grooves 42, etc.) of the turbo-molecular type pump air transfer portion S2 can, therefore, be determined in the same manner as for the upstream edge of the conventional turbo-molecular pumps.

After the standard shape parameters are determined, it is possible to determine the other shape parameters using ordinary turbo-molecular pump design theory. In other words, the downstream edge values of the turbo-molecular type pump air transfer portion S2, such as cubical flow volume (air exhaust volume) (V), compression ratio (R), spacing chord ratio (So/b), vane angle $\theta$, etc., can be determined as the standard shape parameters as follows, for example:

(21) Air exhaust volume (cubical flow volume) (V): V=282 (L/s=liters/s)

Providing that V={cubical flow volume (air exhaust volume) of the downstream edge of the turbo-molecular type pump air transfer portion S2}={the air exhaust volume of the screw type pump air transfer portion S1, i.e., air intake volume at the upstream edge of the screw type pump air transfer portion S1}.

(22) compression ratio (R): R=2.63

(In this case, designed air exhaust velocity at the upstream edge of the turbo-molecular type pump air transfer portion S2 is V×2,6=282×2,63=742 (L/s=liters/s)).

It is noted that the compression ratio R is the initially set value, which is variable when the other multiple shape parameter values are determined while they are adjusted during the actual design process. In such a case, the final air exhaust velocity, too, becomes different from its initially set value.

(23) Spacing chord ratio (So/f):(So/f)=1.0

(The spacing chord ratio is a value calculated using (So/f), with f being the length of the vanes 41 from their upstream edge to their downstream edge, and So being the spacing between two adjacent vanes 41, 41. Providing that So=the average value of the upstream edge spacings of the adjacent vanes 41, 41 and the downstream edge spacings of the same. It is possible to set the spacing chord ratio of the vanes 41 of the upstream edge of the turbo-molecular type pump air transfer portion S2 within the 1±0.2 range, just like in the dynamic vanes of the air intake side of run-of-the-mill turbo-molecular pumps. In this first embodiment, the spacing chord ratio is set at 1.0, the value used generally for the upstream edge of ordinary turbo-molecular pumps.

(24) vane angle $\theta$=30°

(Ordinarily, the vane angle $\theta$ to the tilt angle of screw $\alpha$ of the upstream edge of the screw type pump air transfer portion S1, is $\theta \geqq \alpha$. Further, the air exhaust efficiency value is set in the $\theta$=30°~40° range. Since there is no big difference in the air exhaust efficiency value between $\theta$=30° and $\theta$=40°, and the compression capacity decreases when the value nears 40°, $\theta$=30° is used in this embodiment.

(25) the upstream edge vane width (W1)=2 mm (It is desirable to make the upstream edge vane width (W) as thin as possible so long as its strength can be maintained, because the air intake opening has a larger square area. For this reason, the upstream vane width is set at W1=2 mm. As mentioned above, the vane width (W2) of the downstream edge of the vanes 41 is identical to the thread width of the screws 36 (d=5.65 mm). In other words, W2=5.65 mm. Since the vanes 41, according to this first embodiment, a flat plate shape, the average value (W a) of the vane width (W) is W a=(W 1+W 2)/2=3.33 mm.)

(26) the number of vanes 41=5

(The number of vanes (41)=5 is determined in accordance with the number of the screw grooves 37 (=5) of the screw type pump air transfer portion S1 on the downstream side of the vane 41.)

After the initial values for the above-mentioned standard shape parameters are determined, the approximate values for the other shape parameters of the turbo-molecular type pump air transfer portion S2 are determined based on the turbo-molecular design theory under the condition that the air exhaust volume of the turbo-molecular type air transfer portion S2 equals the air intake volume at the upstream edge of the screw type pump air transfer portion S1. Nevertheless, in reality, a variety of parameter values are changed little by little as calculations are done repeatedly until each of the appropriate values are determined. When calculations are being performed on values using the above-mentioned design theory, as, for example, when the average value of the vane width W a=(W1+W2)/2 is used for the value of the different vane width of the vane 41 at the upstream and downstream edges thereof, even should the vane pitch (the space of the adjacent vanes) at the upstream and downstream edges be different, the average value of all the pitches, from the upstream edge pitches to the downstream edge pitches, is used.

Calculated in this manner, the shape parameter value for the turbo-molecular type air transfer portion S2 is, for example, the following (31) to (35).

(31) vane circumferential length=46 mm

(32) length of the vanes in the axial direction=46 mm

(33) square area of the air intake opening=213 $mm^2$

(34) designed air exhaust velocity of vane at the edge portion of the air intake side=742 L/s The air exhaust velocity value here was calculated according to the formula (see below) used for high vacuum zones (molecular flow zones).

Air exhaust velocity=square area of vane opening×11.6×efficiency=(the square area per one thread)×the number of threads(=5)×11.6×0.618=(4.6×4.5)×5×11.6×0.618=742

Providing that the above-mentioned 11.6 ($L/(s/cm^2)$) represents the air volume of the air molecules passing through the square area of 1 $cm^2$ per second, and the above-mentioned efficiency is a value determined by variables such as the number of rotations, the vane angle, the vane length and the base diameter, etc.

(35) r 2=45 mm

Providing that r 2 is the base radius of the upstream edge of the vanes 41 of the turbo-molecular type pump air transfer portion S2. The groove depth of the aforementioned edge is calculated based on its shape elements, and is determined based on the relationship between the compression capacity and the air exhaust velocity. Although (r 0–r 1)/(length of S2 in the direction of shaft) corresponds to the average tilt angle of the air transfer grooves 42, the compression efficiency is lowered if the average tilt angle is large, and the required length of the turbo-molecular type pump air transfer portion S2 becomes long if the average tilt angle is small. Thus, such being the case, the optimum values for the above-mentioned r 2 should be determined in view of the above. The multiple-type vacuum pump (P) is thus designed in this manner and made on an experimental use thereafter, experiments and tests are conducted by using the experimental multiple-type vacuum pump (P), followed by a number of revisions of the shape, until the optimum shape is determined. In this way, it becomes easy to design and manufacture the multiple-type vacuum pump P with the desired high-volume air evacuation capacity.

(Operation of First Embodiment)

In the multiple-type vacuum pump P, according to the embodiment 1, having the above-mentioned construction, since the vanes 41 are used at the upstream edge of turbo-molecular type pump air transfer portion S2, similar to the first stage dynamic vanes used at the upstream edge in the ordinary turbo-molecular pumps, it is possible to enlarge the square area of the air intake opening to a great extent as compared to the conventional screw type vacuum pumps. The result: By virtue of the geometric shape of the vanes 41, not only can the air exhaust velocity be significantly increased within the free molecule zone, which determines the probability of air molecule influx, but the compression capacity can also be maintained.

The downstream edge (the edge on the discharge side) of the vanes 41 of the turbo-molecular type pump air transfer portion S2 is connected to the screw type pump air transfer portion S1, which performs air evacuation with great velocity even in the slip flow zone (low vacuum zone). Since the thread widths d of the screw threads 36 of the screw type pump air transfer portion S1 are larger than the vane widths W1 of the vanes 41 at the upstream edge of the turbo-molecular type pump air transfer portion S2, the widths of the vanes 41, as shown in FIG. 3C, gradually get larger as they go from the upstream edge to the downstream edge, and are connected to the upstream edge of screw threads 36.

Disturbances created in the stream of air due to sudden changes at the connecting portion of the vanes 41 and the screw threads 36, which would result in a decrease in air evacuation efficiency, are solved by this invention.

In this embodiment, since the vane angle $\theta$ and the screw tilt angle $\alpha$ of the vane 41 is $\theta=\alpha=30°$, it is possible to make a smooth connection between the flat plate shaped vanes 41 and the upstream edge of the screw threads 36. And this, in turn, prevents any disturbances created in the connecting portion of the downstream edge of the vanes 41 and the upstream edge of the screw threads 36.

Furthermore, according to the first embodiment, the base radius of a downstream portion S2*b* of the vanes 41 of the turbo-molecular type pump air transfer portion S2, is made larger (i.e., gets smaller as it goes toward the upstream edge), thereby making a smooth transition in the changes in shape from the turbo-molecular type pump air transfer portion S2 to the screw type pump air transfer portion S1, making it possible to prevent disturbances from occurring in the air being transferred.

Further, the multiple-type vacuum pump P of the first embodiment takes in air molecules through the turbo-molecular type pump air transfer portion S2 situated at the upstream side of the multiple-type vacuum pump, then compresses this air to the predetermined pressure. Because the cubical volume of this compressed air has become small, the cubical air volume taken in at the subsequent screw type pump air transfer portion S2, ends up being even less than in the turbo-molecular type pump air transfer portion S2. Because the air continues to be even more compressed in the screw type pump air transfer portion S1, the cubic volume of the screw grooves 37 also continues to get smaller. In the first embodiment, the screw type pump air transfer portion S1, which meets the requirement of the pressure and volume of the air discharged from the turbo-molecular type pump air transfer portion S2, is designed as described above. Thus, the air evacuation capacity (compression capacity and air evacuation velocity) of the multiple-type vacuum pump on the whole can be improved.

Further, because the air that flows through the air transfer grooves 42 and the screw grooves 37 of the multiple-type vacuum pump P is transferred smoothly, heat generation is reduced and deterioration of the strength of material of the rotor H is lowered, allowing the pump to be operated in even high pressure zones.

Figure 4:
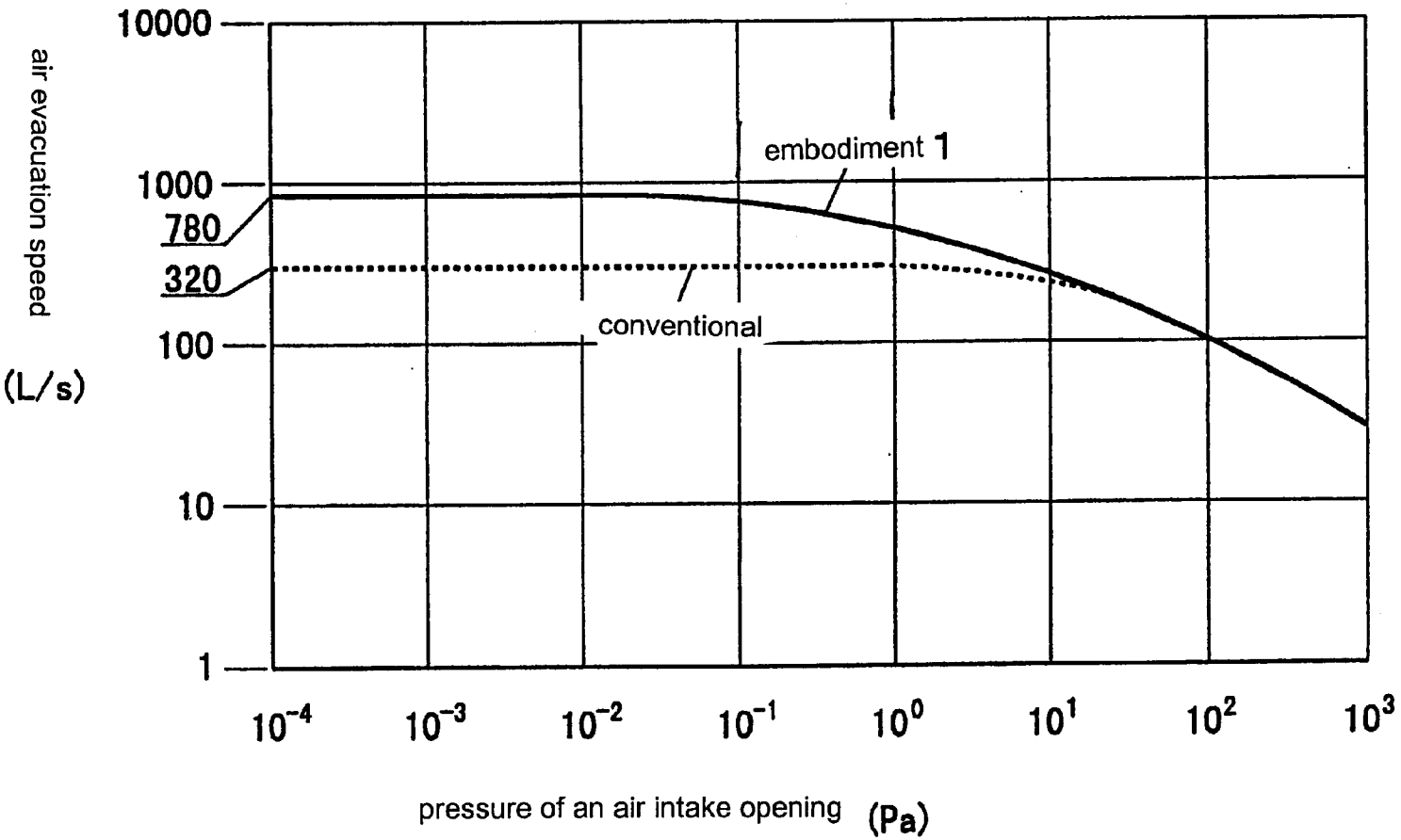
FIG. 4 is a comparative diagram of a multiple-type vacuum pump (P), according to the first embodiment, and a conventional screw type vacuum pump regarding an example of measurements taken on the air evacuation speed relating to the pressure of an air intake opening.

FIG. 4 is a comparative diagram of multiple-type vacuum pump P, according to the first embodiment, and a conventional screw type vacuum pump, regarding an example of measurements taken on the air evacuation speed relating to the pressure of the air intake opening. As will be understood from the graph in FIG. 4, the distinct air evacuation characteristics in the multiple-type vacuum pump P of the first embodiment were improved in the high vacuum zone. Further, the air evacuation velocity in the low vacuum zone is maintained at the same level as that of the conventional screw type vacuum pumps.

(Second Embodiment)

Figures 5, 5A, 5B, 5C, 5D:
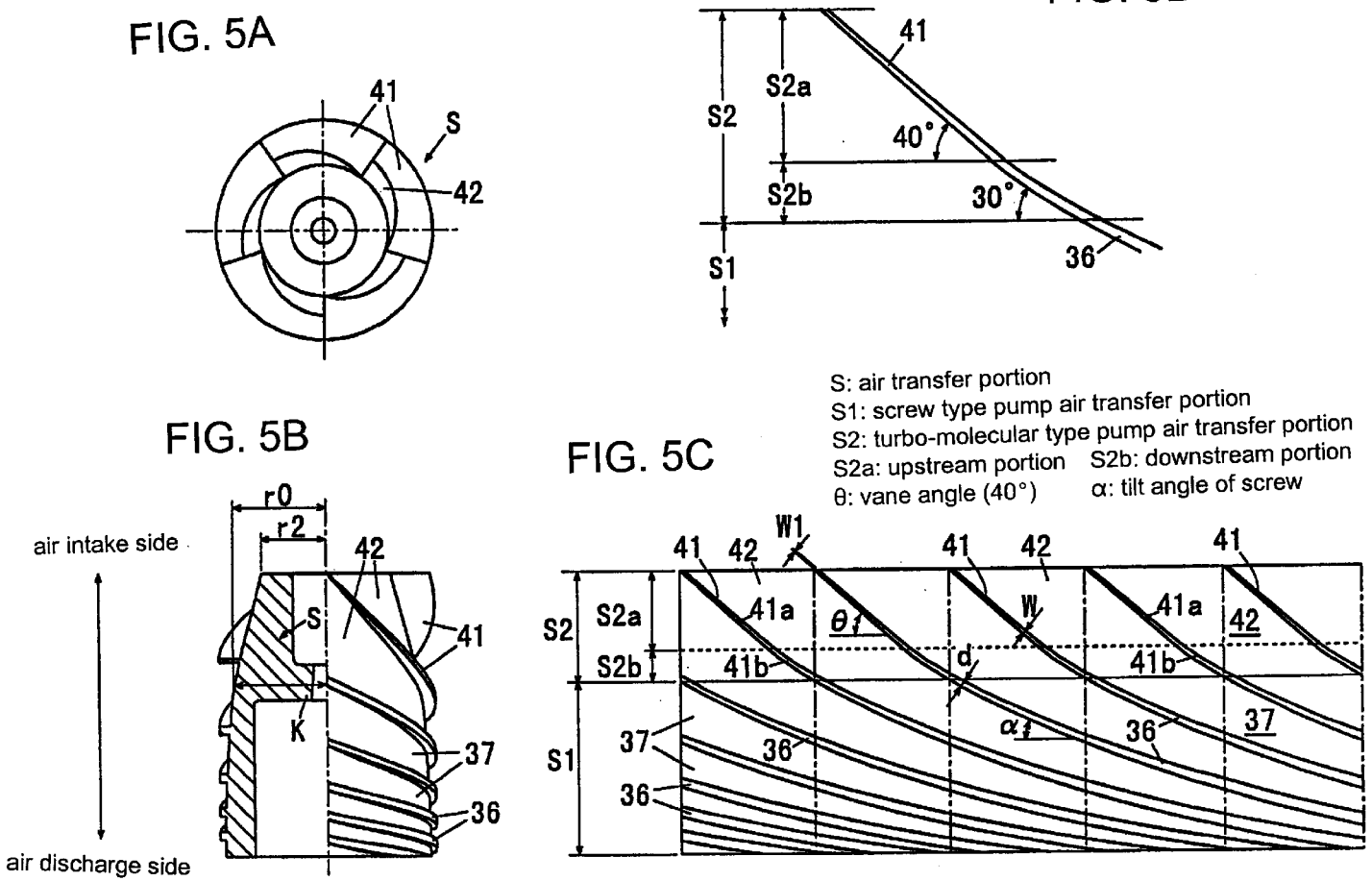

FIG. 5 illustrates a rotor of the multiple-type vacuum pump in a second embodiment according to the present invention, which corresponds to FIG. 3 in the above-mentioned first embodiment. FIG. 5A is a top plan view of the rotor as viewed from the upstream side in the air transfer direction; FIG. 5B is a side view of the rotor; FIG. 5C is a development elevation of the outer surface of the rotor; and FIG. 5D is an enlarged part of the FIG. 5C.

In the description of this second embodiment, the same reference numbers are given to the corresponding parts of the above-mentioned first embodiment to eliminate repetitive explanation. The second embodiment is different from the above-mentioned first embodiment in the following features, but is constructed similarly in other features.

As shown in FIG. 5, the turbo-molecular type pump air transfer portion S2 has an upstream portion S2*a* and a downstream portion S2*b*.

The depth of the air transfer groove 42 of the upstream portion S2*a*, according to the turbo-molecular type pump air transfer portion S2, becomes smaller in a straight line as it goes towards the upstream in the rotary shaft direction. The downstream portion S2*b* is curved to form a convex shape on an outer surface with respect to the rotary shaft so as to connect smoothly the bottom surface of the air transfer groove 42 of the upstream portion S2*a* to the bottom surface of the screw groove 37.

The vane 41 includes a flat plate portion 41*a* mounted on the upstream portion S2*a* and a curved plate portion 41*b* mounted on the downstream portion S2*b*. A vane angle θ of the flat plate portion 41*a* is 40°. The upstream edge of the curved plate portion S2*b* is connected to the downstream edge, having the vane angle of 40°, of the flat plate portion S2*a*. The downstream edge of the curved plate S2*b* is connected to the upstream edge, having a tile angle of screw of α 1, of the screw type pump air transfer portion S1. When the tilt angle α 1 is greater than the vane angle θ (as in the case of the second embodiment, the angles are: θ=40° and α 1=30°), the downstream portion S2*b* is curved so as to be smoothly connected to the flat plate portion S2*a* on its upstream side and to the screw type pump air transfer portion S1 on its downstream side.

(Operation of the Second Embodiment)

When the rotor H rotates, the turbo-molecular type pump air transfer portion S2 compresses the air which had been taken in from its upstream edge, and transfers the air into the upstream edge of the screw type pump air transfer portion S1. In the second embodiment, the vane angle θ is 40° which is greater than the vane angle, θ=30°, in the first embodiment. Therefore, it is possible to increase the air outlet velocity in the high vacuum region.

In the second embodiment, the downstream portion S2*b* is curved to form a convex shape on the outer surface with respect to the rotary shaft so as to smoothly connect the bottom surface of the air transfer groove 42 of the upstream portion S2*a* to the bottom surface of the screw groove 37. This makes it difficult to cause a disturbance on the air flow at the connecting portion between the bottom surface of the air transfer groove 42 and the bottom surface of the screw groove 37.

(Third Embodiment)

Figures 6, 6A, 6B, 6C, 6D:
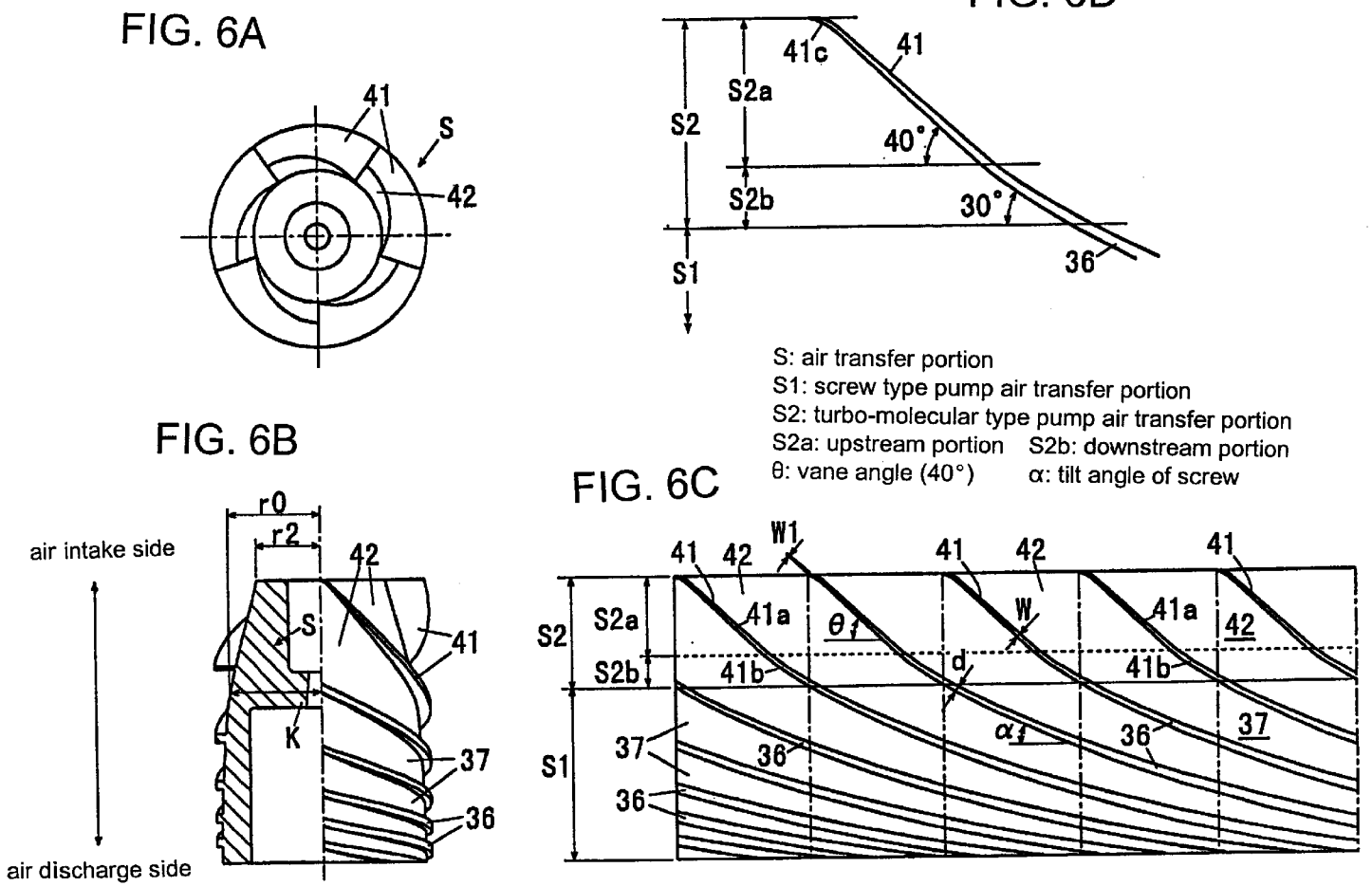

FIG. 6 illustrates a rotor of the multiple-type vacuum pump in a third embodiment according to the present invention, which corresponds to FIG. 5 in the above-mentioned second embodiment. FIG. 6A is a top plan view of the rotor as viewed from the upstream side in the air transfer direction; FIG. 6B is a side view of the rotor; FIG. 6C is a development elevation of the outer surface of the rotor; and FIG. 6D is an enlarged part of the FIG. 6C.

In the description of this third embodiment, the same reference numbers are given to the corresponding parts of the above-mentioned second embodiment to eliminate repetitive explanation.

As shown in FIG. 6, the upstream edge portion 41*c* of the vane 41 of the turbo-molecular type pump air transfer portion S2 is slightly curved toward the downstream side in the direction of the air transfer. (see FIG. 6D). Except for this feature, the third embodiment is constructed similar to the above-mentioned second embodiment.

By changing the degree of the curvature of the upstream edge, curved toward the downstream side in the direction of the air transfer, portion 41*c* of the vane 41, it is possible to control the compression performance of the turbo-molecular type pump air transfer portion.

(Fourth Embodiment)

Figures 7, 7A, 7B, 7C, 7D:
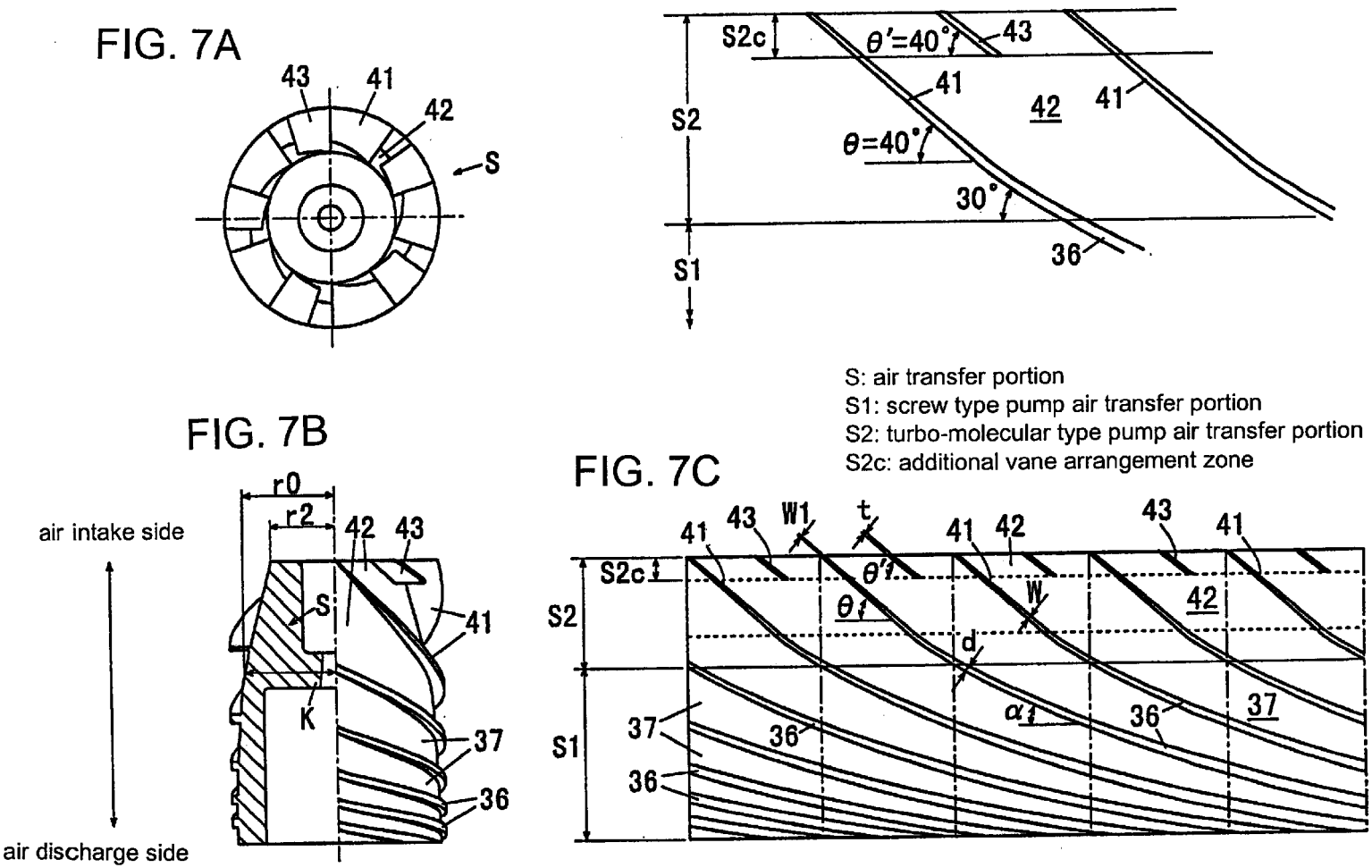

FIG. 7 illustrates a rotor of the multiple-type vacuum pump in the fourth embodiment according to the present invention, which corresponds to FIG. 5 in the above-mentioned second embodiment. FIG. 7A is a top plan view of the rotor as viewed from the upstream side in the air transfer direction; FIG. 7B is a side view of the rotor; FIG. 7C is a development elevation of the outer surface of the rotor; and FIG. 7D is an enlarged part of the FIG. 7C.

In the description of the fourth embodiment, the same reference numbers are given to the corresponding parts of the above-mentioned second embodiment to eliminate repetitive explanation. The fourth embodiment is different from the above-mentioned second embodiment in the following features, but is constructed similarly in other features.

As shown in FIG. 7, the upstream portion S2*c* of the turbo-molecular type pump air transfer portion S2 has a plurality of additional vanes 43 in the shape of flat plates, respectively, which are mounted between the vanes 41.

The thickness t of the additional vane 43 is uniform from the upstream edge to the downstream edge and the value of t is 2 mm. The vane angle θ' of the additional vane 43 is 40°(θ'=40°), and the same as the vane angle θ of the upstream side of the flat plate portion 41*a* of the vane 41

(θ=40°). It is preferable that the thickness t of the additional vane 43 be as thin as possible as long as its strength can be maintained. The vane angle θ' of additional vane 43 is set in the range of θ'≧θ, while the range of the vane angle θ of the vane is θ≧α 1.

(Operation of the Fourth Embodiment)

In the fourth embodiment of the multiple-type vacuum pump, according to the present invention, which comprises the above-mentioned structure, it is possible to control the volume of the sucked air and the air compression ratio, by setting up properly the vane angle θ', the vane thickness t , and the length of the additional vanes 43 which are mounted respectively between the plurality of vanes 41 of the upstream portion S2*c* of the turbo-molecular type pump air transfer portion S2. Furthermore, since the additional vanes 43 are made of flat plates, they are easier to be designed and manufactured.

(Fifth Embodiment)

FIG. 8 illustrates a rotor of the multiple-type vacuum pump in a fifth embodiment according to the present invention, which corresponds to FIG. 3 in the above-mentioned first embodiment. FIG. 8A is a top plan view of the rotor as viewed from the upstream side in the air transfer direction; FIG. 8B is a side view of the rotor; FIG. 8C is a development elevation of the outer surface of the rotor; and FIG. 8D is an enlarged part of the FIG. 8C.

In the description of this fifth embodiment, the same reference numbers are given to the corresponding parts of the above-mentioned second embodiment to eliminate repetitive explanation.

As shown in FIG. 8, the upstream portion S2*a* of the vane 41 of the turbo-molecular type pump air transfer portion S2 is made in the form of a flat plate, and the downstream portion of the vane 41 of the downstream portion S2*b* is of a curved plate. The tilt angle of screw α 1 of the upstream edge of the screw type pump air transfer portion S1 is 30°, and the vane angle θ of the vane 41 of the upstream portion S2*a* of the turbo-molecular type pump air transfer portion S2 is 40°. The curved plate portion of the downstream portion of the vane 41 is curved so as to smoothly connect to the upstream edge of the screw thread 36 of the screw type pump air transfer portion S1.

In the first to fourth embodiments of the turbo-molecular type pump air transfer portion S2, as shown in the foregoing FIGS. 3C, 5C, 6C and 7C, the downstream edge of a vane 41 of the turbo-molecular type pump air transfer portion S2 and the upstream edge of an adjacent vane 41 are located at the same longitude in a circumferential direction. In the fifth embodiment, however, as shown FIG. 8, the downstream edge of a vane 41 and the upstream edge of the adjacent vane 41 are spaced from each other in a circumferential direction.

Depending on the rotation speed of the rotor H and values of the parameter, such as a vane shape, a multiple-type vacuum pump P, as shown in FIG. 8, is constructed, It is also possible to construct a multiple-type vacuum pump P which has a function similar to that of the above-mentioned first embodiment.

(Sixth Embodiment)

FIG. 9 illustrates a rotor of the multiple-type vacuum pump in a sixth embodiment according to the present invention, which corresponds to FIG. 8 in the above-mentioned fifth embodiment. FIG. 9A is a top plan view of the rotor as viewed from the upstream side in the air transfer direction; FIG. 9B is a side view of the rotor; FIG. 9C is a development elevation of the outer surface of the rotor; and FIG. 9D is an enlarged part of the FIG. 9C.

In the description of this sixth embodiment, the same reference numbers are given to the corresponding parts of the above-mentioned second embodiment to eliminate repetitive explanation.

As shown in FIG. 9, five vanes 41, which are similar to those of the fifth embodiment, are mounted on the downstream portion S2*d* of the turbo-molecular type pump air transfer portion S2, and five additional flat-plate-shape vanes 44 are mounted on the upstream portion S2*e*. The five additional vanes 44 provided on the upstream side are located at the midpoints, in a circumferential direction, of the five vanes 41 provided on the downstream side.

The tilt angle of screw α 1 of the upstream edge of the screw type pump air transfer portion S1 is 30°. The vane angle of the vane 41 of the downstream portion S2*d* of the turbo-molecular type pump air transfer portion S2 is 30°. The vane angle θ of the additional vane 44 of the upstream portion S2*e* is 40°. It is also possible to construct a multiple-type vacuum pump P, as shown FIG. 9, by setting up a proper compression ratio of the turbo-molecular type pump air transfer portion S2. It is possible to construct a multiple-type vacuum pump P which has the same function as that of the first embodiment.

(Seventh Embodiment)

Figure 10:
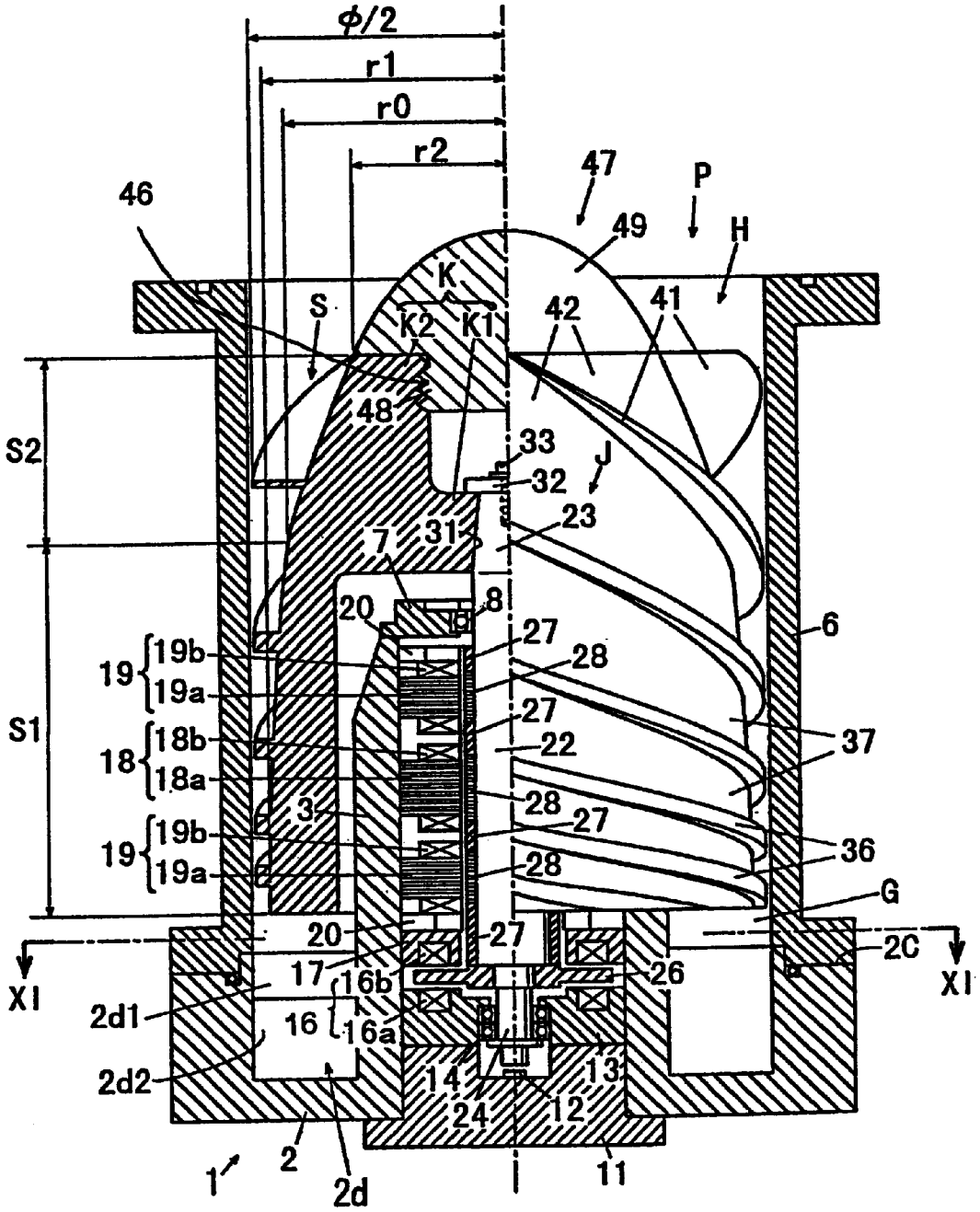
FIG. 10 is a vertical cross-sectional view of the multiple-type vacuum pump, according to a seventh embodiment of the present invention.
Figure 11:
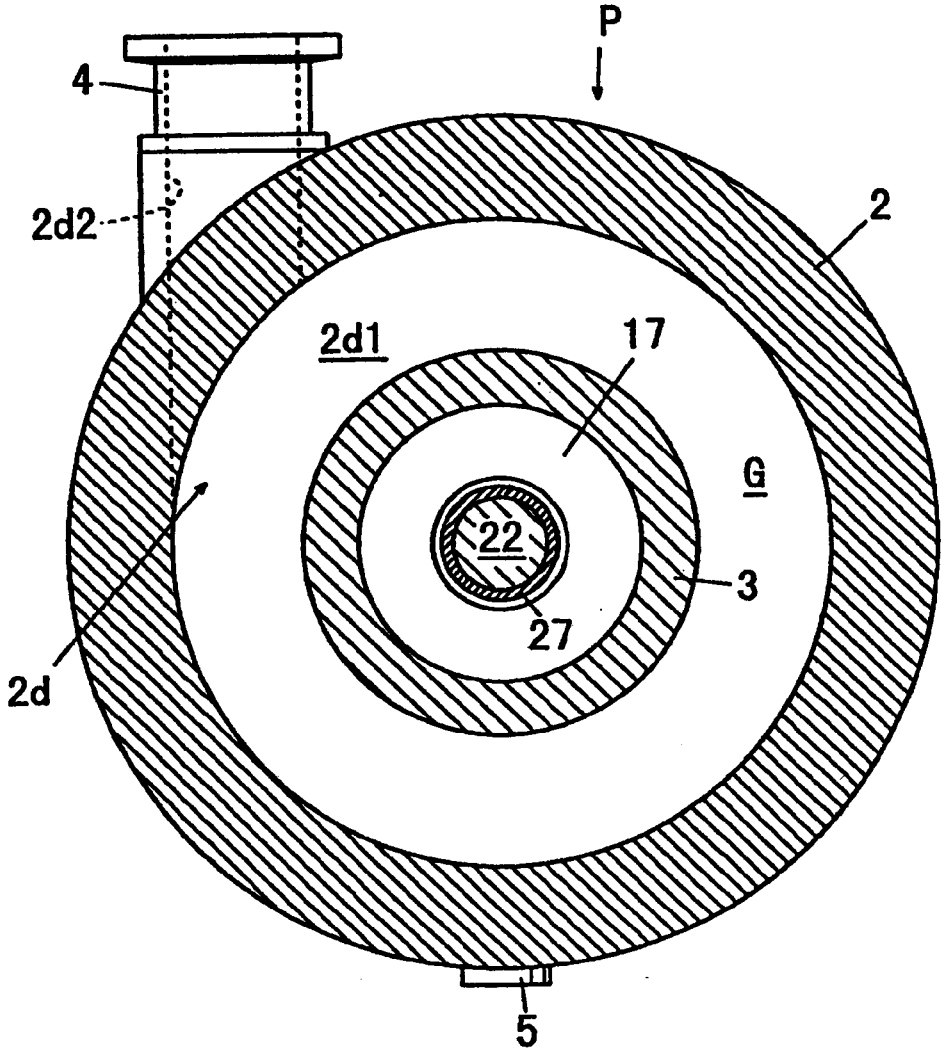
FIG. 11 is a cross-sectional view of FIG. 10 along the line XI—XI.

FIG. 10 shows a vertical section of the multiple-type vacuum pump of a seventh embodiment according to the present invention. FIG. 11 shows a section along the line XI—XI of the FIG. 10.

In the description of the seventh embodiment, the same reference numbers are given to the corresponding parts of the above-mentioned first embodiment to eliminate repetitive explanation. The seventh embodiment is different from the above-mentioned first embodiment in the following features, but is constructed similarly in other features.

As shown in FIG. 10, a female screw thread 46 is formed at the upstream edge of the turbo-molecular type pump air transfer portion S2. A straightening member 47 has a male screw 48, which is screwed into the female screw thread 46. The straightening member 47 has an airflow guide surface 49, which is made of a curved surface and symmetric with respect to the axis protruding towards the upstream side. The downstream edge of the airflow guide surface 49 is constructed so as to be smoothly connected to the upstream edge of the base surface of the air transfer groove 42 of the turbo-molecular type pump air transfer portion S2. This straightening member thus guides the airflow to the base surface of the upstream edge of the air transfer groove of the turbo-molecular type pump air transfer portion.

Therefore, an air intake efficiency increases especially in a low vacuum region where an air density is high.

The flange 2 of the seventh embodiment has an air outlet 2*d* instead of the air outlet 2*a* of the first embodiment. The air outlet 2*d* has an air circulation groove 2*d*1 and a tangential air outlet 2*d*2, the first being located in an upstream portion and maintains a uniform depth and the latter being located in a downstream portion. The air circulation groove 2*d*1 is made of a cylindrical wall of smaller diameter and a cylindrical wall of larger diameter, and forms a ring shape viewed in the axial direction of the rotary shaft of the rotor H. The upstream edge of the ring-shaped air circulation groove 2*d*1 is connected to the air outlet space G which is created between the downstream edge of the rotor H and the upstream edge of the flange 2.

The tangential air outlet 2*d*2 is formed in a tangential direction extended from the outer peripheral wall of the cylindrical walls which constitutes the air circulation groove 2*d*1. The tangential air outlet 2*d*2 is disposed at the lower end of the air circulation groove 2*d*1 whose depth is uniform, and the base wall of the air circulation groove 2*d*1 and the bottom portion of the inside surface of the tangential air outlet 2*d*2 are formed on the same plane. Air is discharged from the downstream edge of the rotor H, circulating through the ring-shaped air outlet space G, and moves downwardly circulating through the ring-shaped air circulation groove 2*d*1. Then the air is discharged from the lower end of the air circulation groove 2*d*1 into the tangential air outlet 2*d*2.

Therefore, the air discharged from the downstream edge of the rotor H is smoothly discharged from the multiple-type vacuum pump P.

(Eighth Embodiment)

Figure 12:
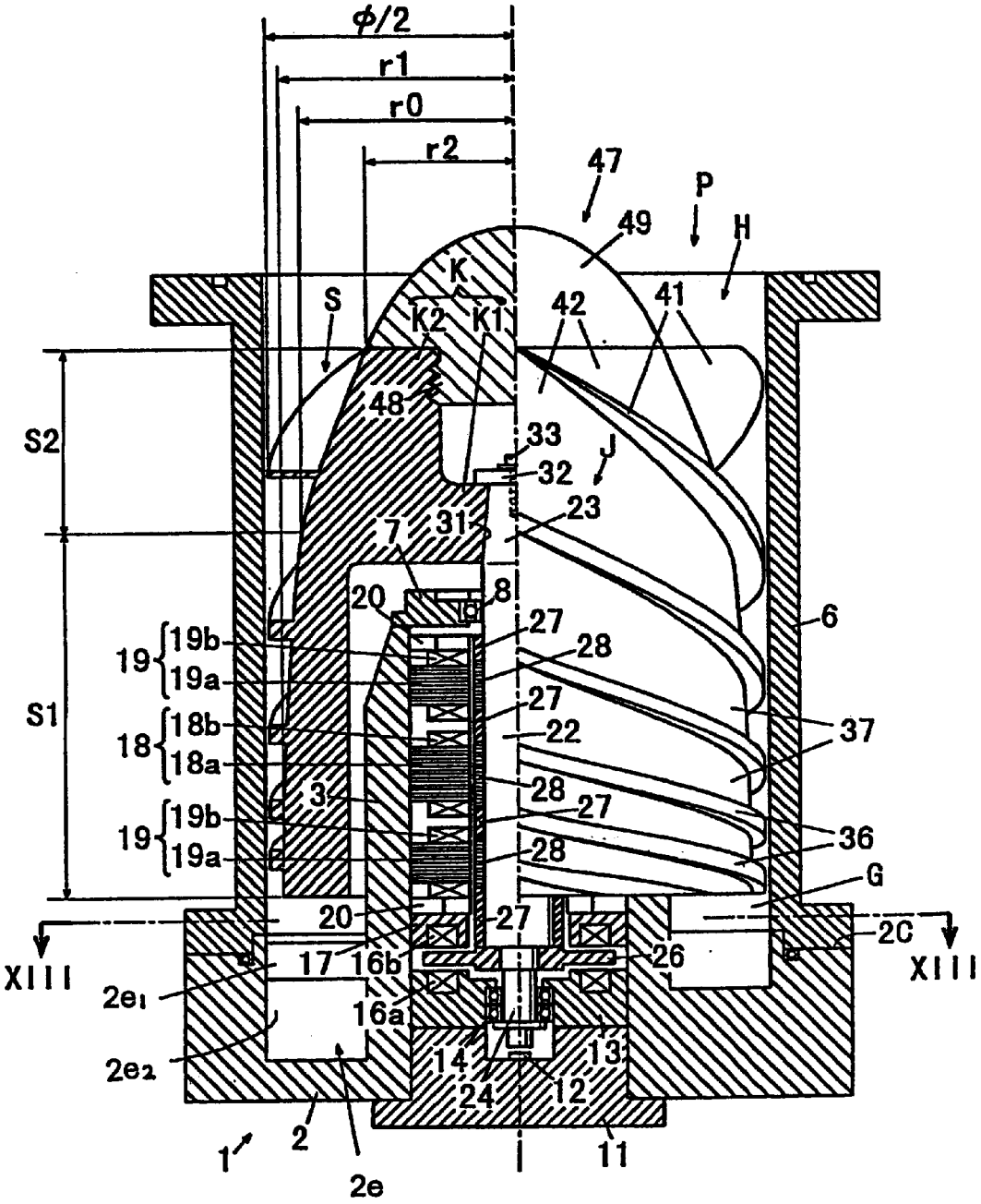
FIG. 12 is a vertical cross-sectional view of the multiple-type vacuum pump, according to an eighth embodiment of the present invention.
Figure 13:
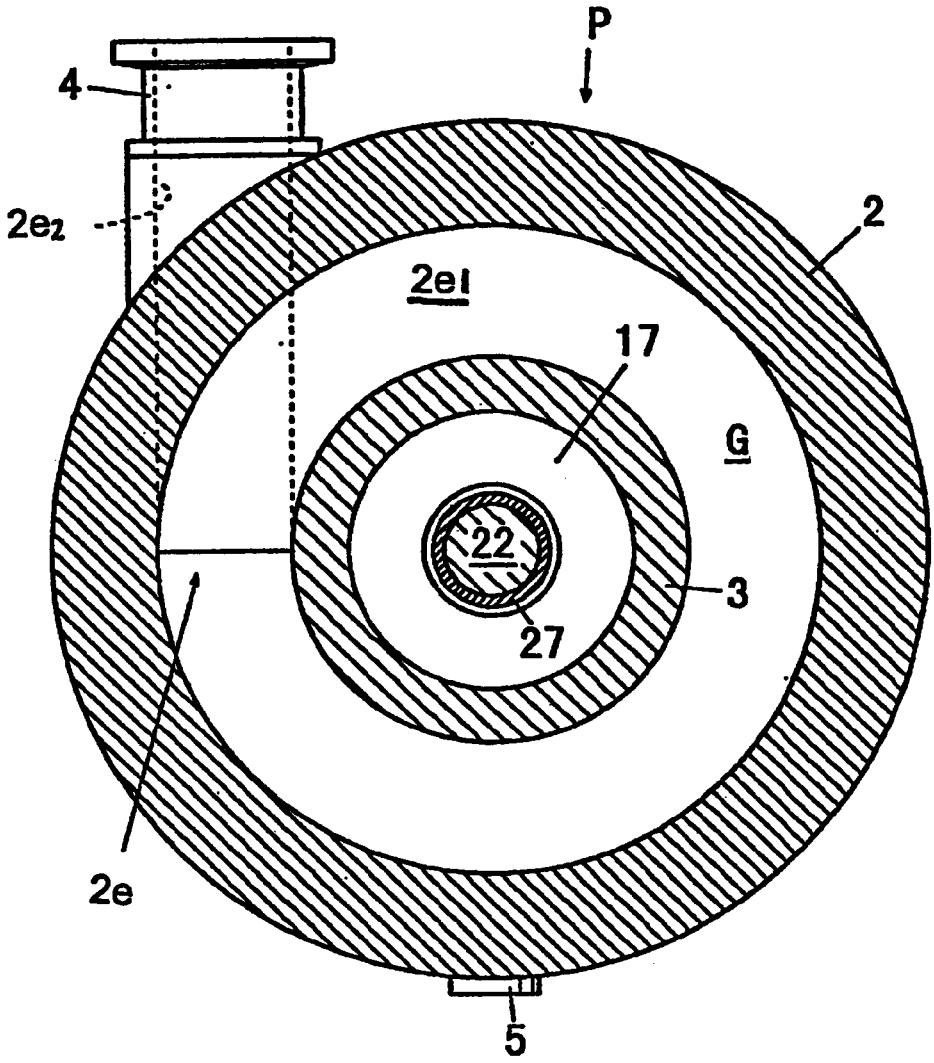
FIG. 13 is a cross-sectional view of FIG. 12 along the line XIII—XIII showing the air evacuation construction of the eighth embodiment.
Figure 14:
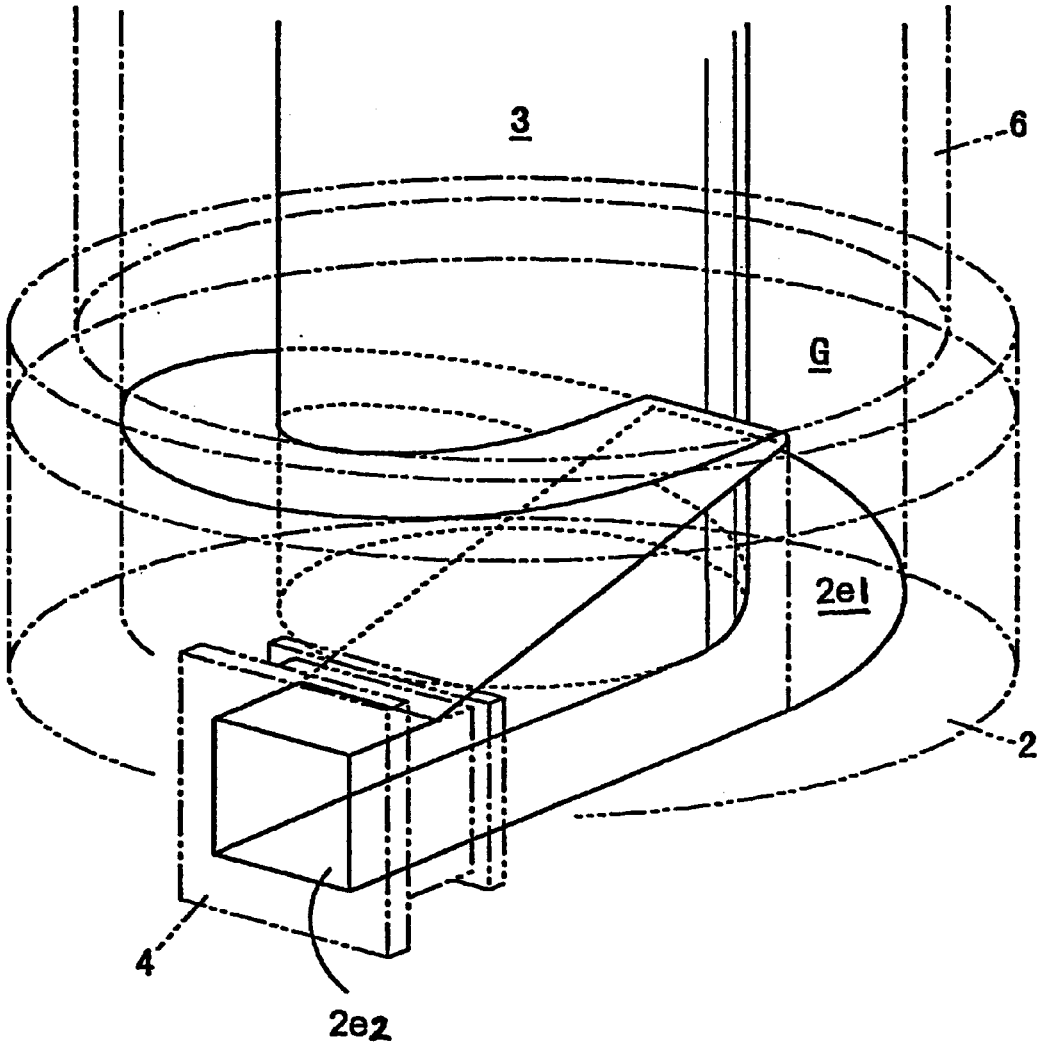
FIG. 14 is a perspective view showing the air evacuation construction.

FIG. 12 shows a vertical section of the multiple-type vacuum pump of an eighth embodiment of the current invention. FIG. 13 shows a section along the line XIII—XIII of the FIG. 12. FIG. 14 is a perspective view describing the construction of the air outlet.

In the description of the eighth embodiment, the same reference numbers are given to the corresponding parts of the above-mentioned seventh embodiment to eliminate repetitive explanation. The eighth embodiment is different from the above-mentioned seventh embodiment in the following features, but is constructed similarly in other features.

As shown FIGS. 12 to 14, the flange 2 of the eighth embodiment has an air outlet 2*e* instead of the air outlet 2*d* of the seventh embodiment. The air outlet 2*e* has an air circulation groove 2*e*1 and a tangential air outlet 2*e*2, the first being located in the upstream portion and the latter being in the downstream portion. The tangential air outlet 2*e*2 is constructed in the game way as the tangential air outlet 2*d*2 of the seventh embodiment. The air circulation groove 2*e*1 is different from the air circulation groove 2*d*1 of the seventh embodiment in that the base surface of the air circulation groove 2*e*1 becomes deeper as it spirals downward, whereas the air circulation groove 2*d*1 maintains a uniform depth. The deepest point of the air circulation groove 2*e*1 is connected to the upstream edge of the tangential air outlet 2*e*2.

Air is discharged from the downstream edge of the rotor H, circulating through the ring-shaped air outlet space G, and moves downwardly circulating along the spiral-shaped base surface of the air circulation groove 2*e*1. The air is then discharged from the downstream edge of the air circulation groove 2*e*1 into the tangential air outlet 2*e*2.

Therefore, the air discharged from the downstream edge of the rotor H is smoothly discharged from the multiple-type vacuum pump P.

(Ninth Embodiment)

Figure 15:
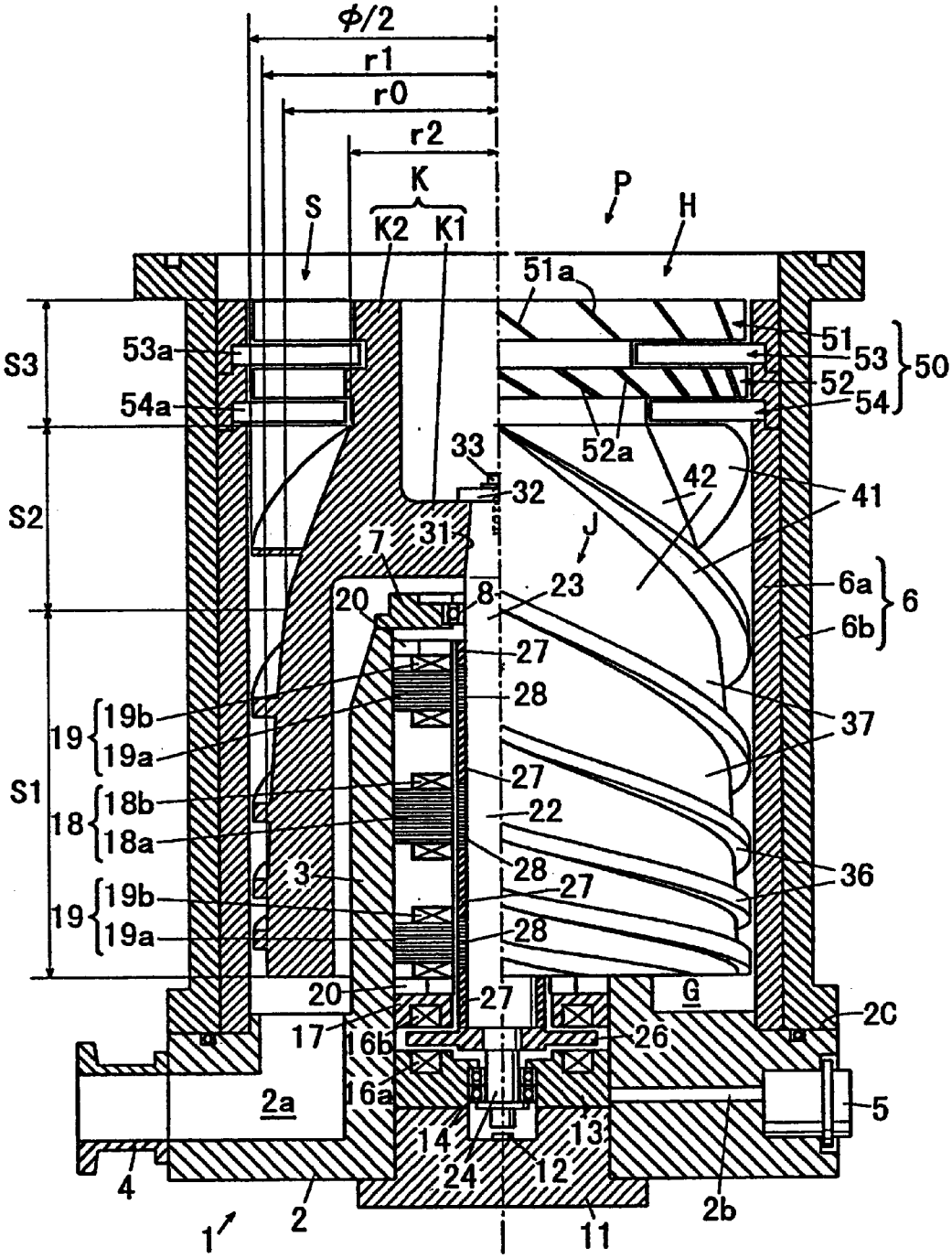
FIG. 15 is a vertical cross-sectional drawing showing the multiple-type vacuum pump, according to a ninth embodiment of the present invention.

FIG. 15 shows a vertical section of the multiple-type vacuum pump of a ninth embodiment according to the present invention.

Figure 16:
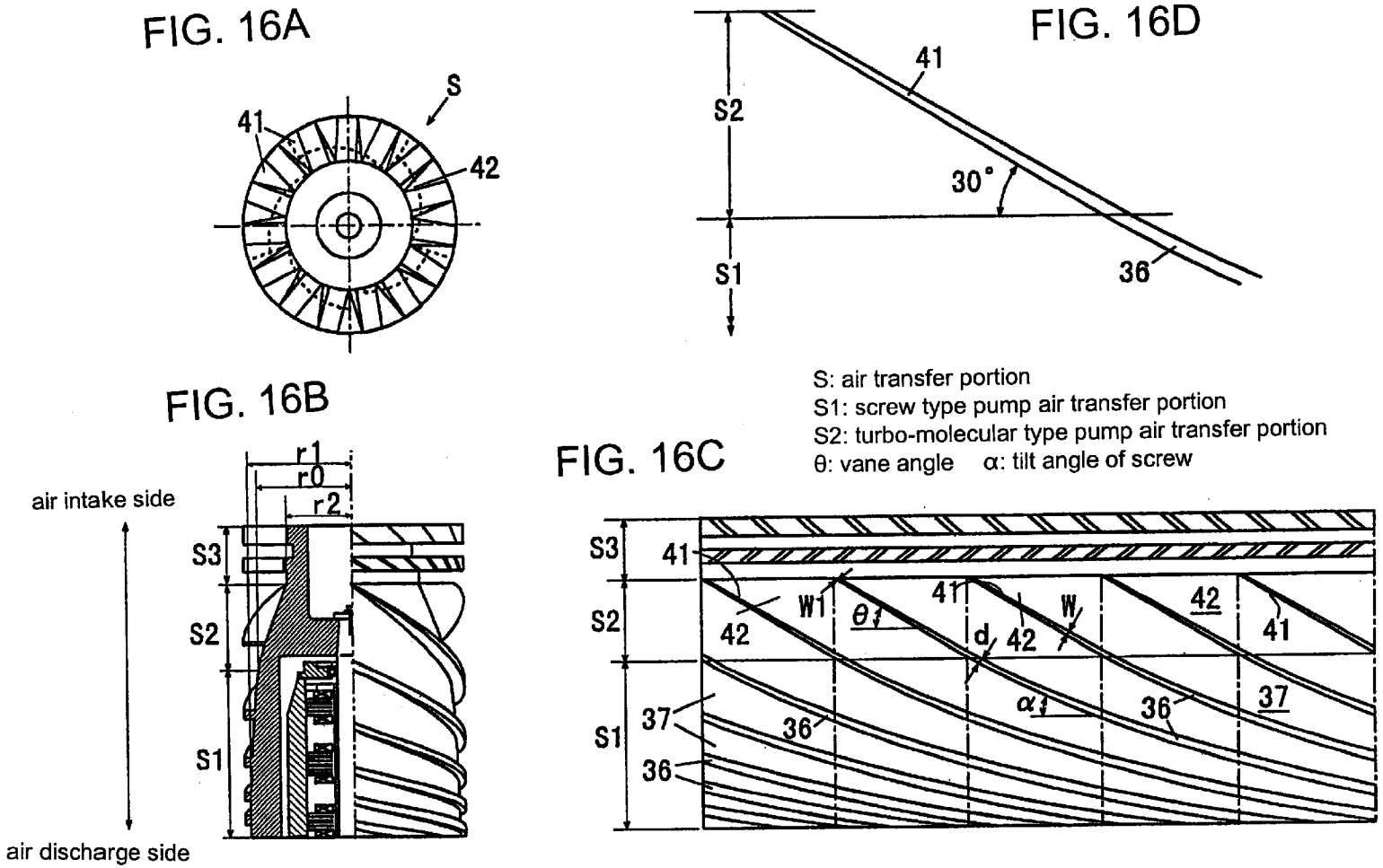
Figure 17:
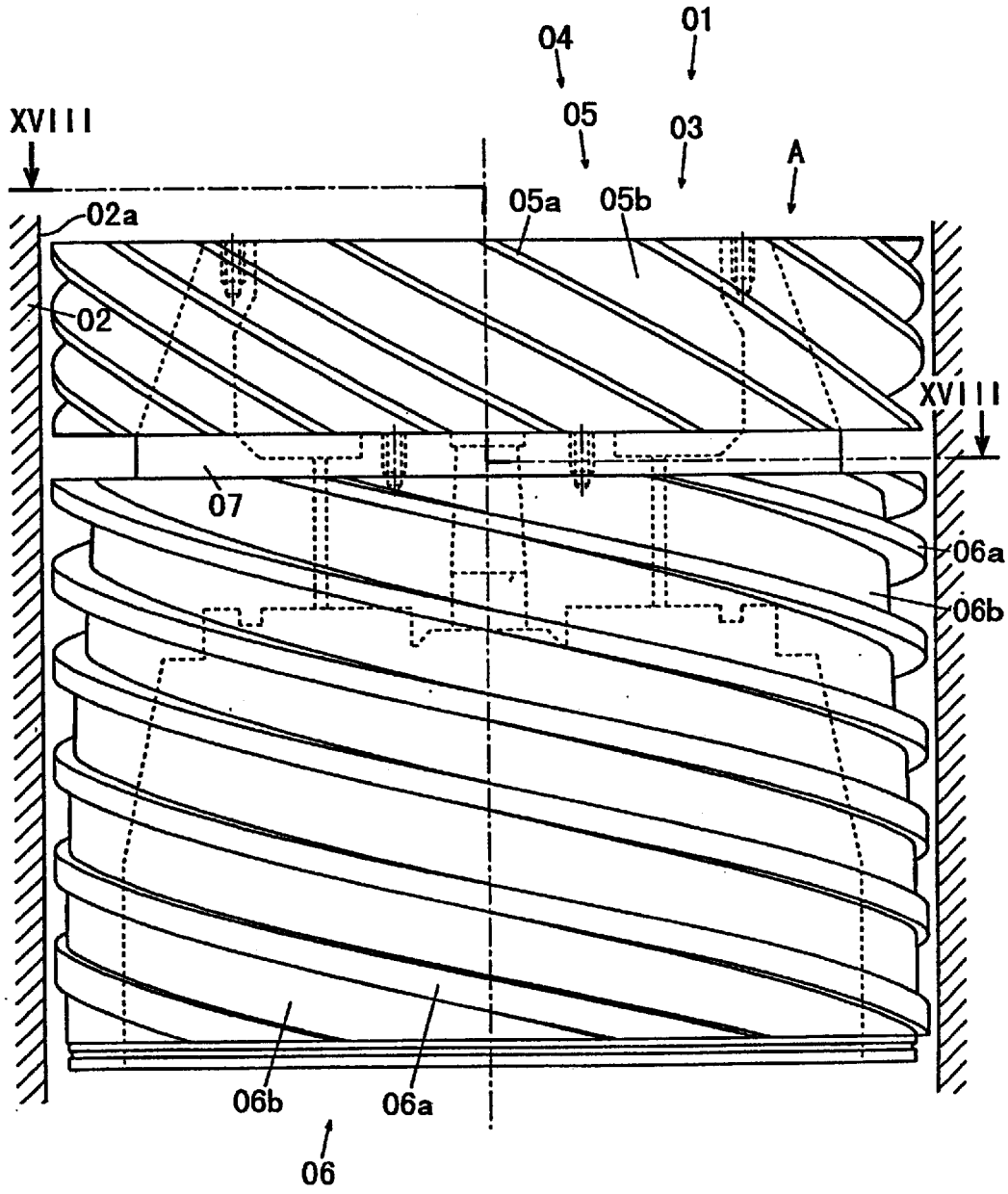
FIG. 17 Prior Art
FIG. 17 is a drawing showing the side view of the rotor of a prior art multiple-type vacuum pump which has been on the market and was developed by applicants of the present invention.
Figure 18:
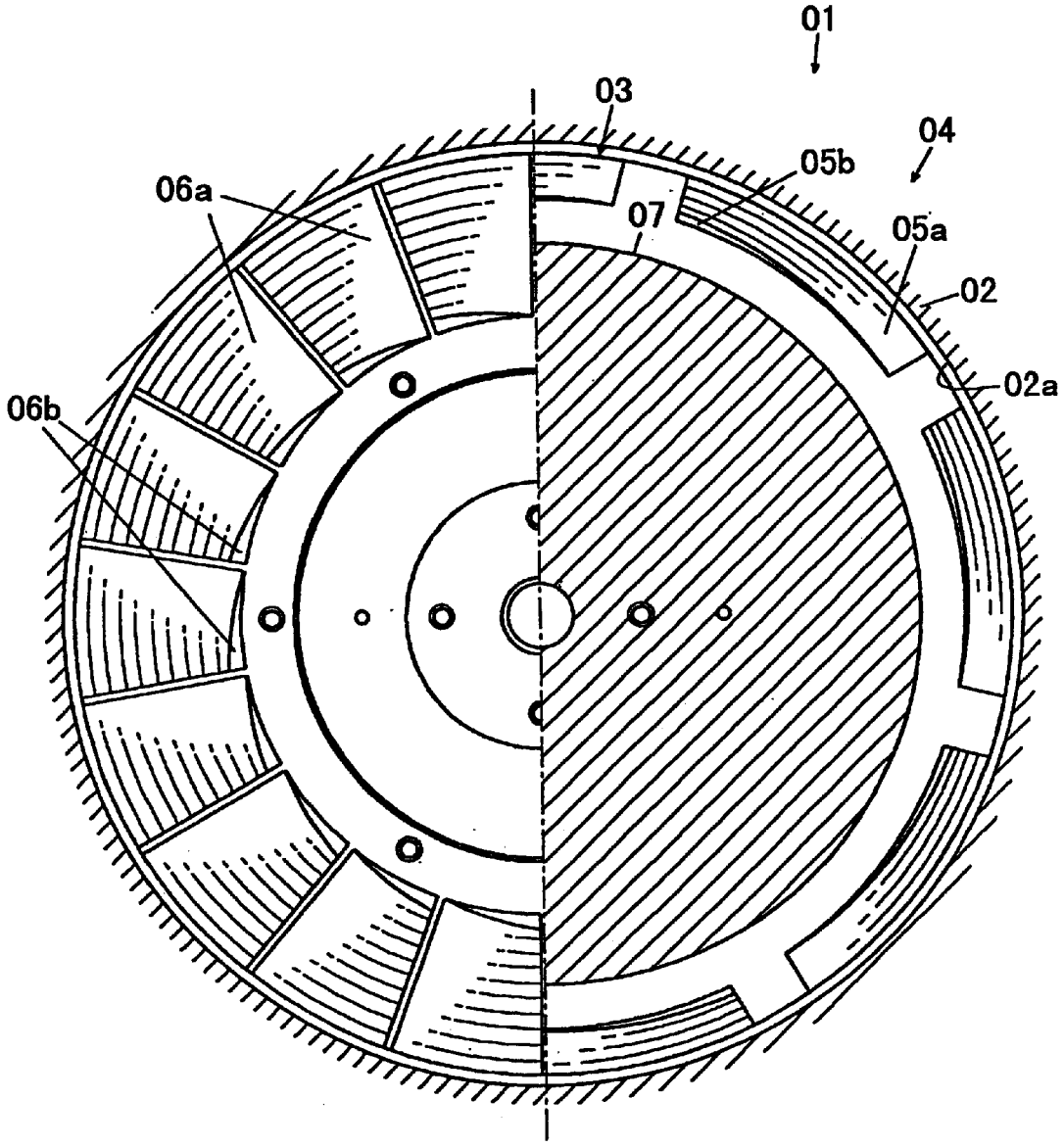
FIG. 18 Prior Art
FIG. 18 is a cross-sectional view of FIG. 17 along the line XVIII—XVIII.

FIG. 16 illustrates the rotor of the embodiment 15. FIG. 16A is a top plan view of the rotor as viewed from the upstream side in the air transfer direction; FIG. 16B is a side view of the rotor; FIG. 16C is a development elevation of the outer surface of the rotor; and FIG. 16D is an enlarged part of the FIG. 16C.

In the description of this ninth embodiment, the same reference numbers are given to the corresponding parts of the above-mentioned first embodiment to eliminate repetitive explanation. The ninth embodiment is different from the above-mentioned first embodiment in the following features, but is constructed similarly in other features.

As shown in FIGS. 15 and 16, according to the ninth embodiment, the multiple-type vacuum pump P has a turbo-molecular pump zone S3 on the upstream side of the turbo-molecular type pump air transfer portion S2 of the multiple-type vacuum pump P of the first embodiment. The turbo-molecular pump zone S3 has a turbo molecule pump 50, where dynamic vanes and static vanes are alternately mounted in the air transfer direction.

The rotor H of the ninth embodiment has a first stage dynamic vane wheel 51, having a plurality of dynamic vanes 51*a,* and a second stage dynamic vane wheel 52, having a plurality of dynamic vanes 52*a,* on the upstream side of the upstream edge of the turbo-molecular type pump air transfer portion S2.

The casing 6 has an inner cylinder 6*a* and an outer cylinder 6*b*. A first stage static vane wheel 53, having a plurality of static vanes 53*a,* and a second stage static vane 54, having a plurality of static vanes 54*a,* are supported by the inner cylinder 6*a*.

The vane wheels 51 to 54 are mounted alternately from the upstream side of the air transfer direction, beginning with the dynamic vane wheel 51, the static vane wheel 53, the dynamic vane wheel 52, and the static vane wheel 54.

The turbo molecule pump 50 is constructed by the vane wheels 51 to 54.

(Operation of the Ninth Embodiment)

Compared with the first embodiment, the multiple-type vacuum pump P of the ninth embodiment, having the aforementioned structure, especially by using the turbo molecule pump 50, obtains a higher compression rate and can achieve higher discharge performance in a superhigh vacuum region.

By combining the vane 41 and the groove 42 of the turbo-molecular type pump air transfer portion S2 with the turbo molecule pump 50, which is mounted on the upstream side of the turbo-molecular pump zone S2, even if the number of the stages of the vane wheels of the turbo molecule pump 50 is reduced, it is possible to achieve the same discharge performance as that of the turbo molecule pump which has more numbers of stages of the vane wheels. That is, the multiple-type vacuum pump P can achieve a high performance in spite of its smaller number of the stages of the vane wheels and lower costs.

Embodiments of the present invention are not limited to those whose detailed explanation has been made above. It is possible to make various modifications on embodiments of the present invention within the scope of the present invention which is described in the claims. Examples of modifications of the present invention will be described as follows:

In the sixth embodiment, another additional vane can be mounted on the upstream side of the additional vane 44. That is, multiple stages of vanes can be mounted on the turbo-molecular type pump air transfer portion S2. In this case, it is possible to increase the compression performance of the turbo-molecular type pump air transfer portion S2.

It is possible to place a turbo molecule pump having dynamic vanes and static vanes mounted, alternately and in the air transfer direction, on the upstream side of the turbo-molecular type pump air transfer portion S2 of the above-mentioned embodiments 1 to 8.

It is possible to bend the upstream edge portions of each of the vanes, according to the respective embodiments as described above, towards the upstream side in the air transfer direction instead of bending them towards the downstream side. In this case, by adjusting the bending degree, it is also possible to control the compression performance and discharge velocity of the turbo-molecular type pump air transfer portion.

It is possible to use other bearings, such as a kinetic pressure bearing, instead of the magnetic bearing used in the above mentioned embodiments.

The air transfer groove 42 of the turbo-molecular type pump air transfer portion S2 is constructed such that the air transfer groove 42 becomes deeper as it goes to the upstream edge. The air transfer groove 42, however, can be constructed such that the air transfer groove 42 could maintain the same depth from the upstream edge to a certain point at the downstream side, and become shallower as it goes beyond that point towards further downstream side.

The structure of the air outlets 2*d* and 2*e* of the seventh and eighth embodiments can be applied not only to the multiple-type vacuum pump P of these embodiments, but also to the air outlet of the screw type pump.

What is claimed is:

1. A multiple-type vacuum pump, comprising:

a rotatable rotor, within a casing having a cylindrical inner surface, around a rotary shaft disposed in coaxial alignment with said casing, said rotor having an air transfer portion on an outer surface thereof for transferring air in a direction of said rotary shaft at the time of rotation;

said air transfer portion having a turbo-molecular type pump air transfer portion located at an upstream portion of an air transfer direction, and a screw type pump air transfer portion located at a downstream portion;

said screw type pump air transfer portion having a plurality of screw threads each having a spiral shape with a width of 5 mm or more and disposed circumferentially at prescribed intervals in said downstream portion of said outer surface of said rotor, and screw grooves formed between each of said screw threads, said screw type pump air transfer portion taking in the air that has streamed into an upstream edge thereof at the time of rotation and transferring it to the downstream side; and said turbo-molecular type air transfer portion having a plurality of vanes with a fixed vane angle and formed circumferentially at prescribed intervals in said upstream portion of said outer surface of said rotor, and air transfer grooves formed between each of said vanes, each of said vanes having an upstream edge with a width of 3 mm or less and a downstream edge formed as to be continuous with an upstream edge of said screw threads of said screen type pump air transfer portion, a downstream edge of a base of said air transfer grooves formed as to be continuous with an upstream edge of a base of said screw grooves, wherein said turbo-molecular type air transfer portion takes the air that has been brought in from an upstream edge at the time of rotation, compresses it, then transfers it to the upstream edge of said screw type pump air transfer portion.

2. The multiple-type vacuum pump as recited in claim 1, wherein each of said plurality of vanes of said turbo-molecular type air transfer portion has a thickness that is identical to a thread width of said screw threads at the downstream edge of said vane and the thickness decreases as said vanes make their way to the upstream edge.

3. The multiple-type vacuum pump as recited in claim 1, wherein each of said plurality of vanes of said turbo-molecular type air transfer portion has a reducing thickness portion, which is equal to the width of said screw threads at the downstream edge thereof and which narrows as it goes toward the upstream edge thereof, and a uniformed thickness portion on an upstream side of said reducing thickness portion.

4. The multiple-type vacuum pump as recited in claim 2 or 3, wherein each of said plurality of vanes of said turbo-molecular type air transfer portion is a plate-shaped member whose thickness is greater at the downstream edge than at the upstream edge.

5. The multiple-type vacuum pump as recited in claim 2 or 3, wherein each of said plurality of vanes of said turbo-molecular type air transfer portion is a plate-shaped member having a flat plate portion at an upstream portion thereof and a curved plate portion at a downstream portion thereof that is smoothly connected to the upstream edge of said screw type pump air transfer portion.

6. The multiple-type vacuum pump as recited in claim 1, wherein the upstream edge portion of each of said plurality of vanes of said turbo-molecular type air transfer portion is curved at the downstream side toward the air transfer direction, and the downstream portion thereof is smoothly connected to the upstream edge of said screw type pump air transfer portion.

7. The multiple-type vacuum pump as recited claim 1, wherein said air transfer grooves of said turbo-molecular type pump air transfer portion are formed so as to become deeper as they go toward an upstream edge thereof.

8. The multiple-type vacuum pump as recited in claim 7, wherein a base diameter of said turbo-molecular pump air transfer portion, which is a diameter of a circle including a circumference of a base of said vanes that lie in a cross-sectional plane perpendicular to said rotary shaft, is formed so as to be on a conical plane whose diameter becomes smaller as it goes toward the upstream side.

9. The multiple-type vacuum pump as recited in claim 1, wherein a spacing chord ratio (So/f) of said turbo-molecular type pump air transfer portion satisfies the following formula:

$$1-0.2 \leqq (So/f) \leqq 1+0.2$$

where f represents a length of each of said plurality of vanes from upstream to downstream edges thereof, and So represents a space between each adjacent vane.

10. The multiple-type vacuum pump as recited in claim 9, wherein said spacing chord ratio (So/f) is calculated such that said space between each adjacent vane So is the average value of each of the spaces from the upstream edge to the downstream edge, between adjacent each vane.

11. The multiple-type vacuum pump as recited in claim 1 wherein a vane angle $\theta$ to a screw tilt angle $\alpha$ 1 of the upstream edge of said screw threads satisfy: $\theta \geqq \alpha$ 1 is provided in said air transfer portion.

12. The multiple-type vacuum pump as recited in any one of claim 1, wherein an upstream edge vane angle $\theta$ 1 of the above-mentioned vanes, the downstream edge vane angle $\theta$ 2, and the screw tilt angle $\alpha$ 1 of said screw threads satisfy: $\theta$ 1$\geqq\theta$ 2=$\alpha$ 1 is provided in said air transfer portion.

13. The multiple-type vacuum pump as recited in claim 1, wherein a groove width ratio {W2/(W1+W2)} is set at {W2/(W1+W2)}$\geqq$9.5, where W1 is the width of the upstream edge of said vanes, and W2 is the width of said air transfer grooves, is provided in said turbomolecular type pump air transfer portion.

14. The multiple-type vacuum pump as recited in any one of claim 1, wherein a plurality of additional vanes are provided on the upstream portion of said turbo-molecular type air transfer portion.

15. The multiple-type vacuum pump as recited in claim 1, wherein a turbo-molecular pump is provided, having a plurality of dynamic vanes and a plurality of static vanes, arranged alternately along the direction of air transfer at a further upstream side of the upstream edge of said turbo-molecular type pump air transfer portion, and wherein said dynamic vanes are provided around an outer circumference of said rotor, and said static vanes are provided within an inner surface of said casing.

16. The multiple-type vacuum pump as recited in claim 1, wherein a cubical flow volume (V1) at the upstream edge of said screw type pump air transfer portion, under steady rotational conditions of said rotor, a cubical flow volume (V2) and compression ratio (n) at the upstream edge of said turbo-molecular type pump air transfer portion satisfy: V 1=V 2/n is provided in said air transfer portion.

17. The multiple-type vacuum pump as recited in claim 1, said screw type pump air transfer portion and said turbo-molecular type pump air transfer portion are formed as one integral structure in said air transfer portion.

18. The multiple-type vacuum pump as recited in claim 1 including a flow straightening member having an air flow guide surface formed to be a symmetrical curved plane with respect to an axis which protrudes toward the upstream side from the upstream edge of said turbo-molecular type air transfer portion, said air flow guide guiding air into a base plane of the upstream edge of said air transfer grooves of said turbo-molecular type pump air transfer portion.

19. The multiple-type vacuum pump as recited in claim 1 including an air outlet space which is ring-shaped formed by a larger diameter cylindrical wall and a smaller diameter cylindrical wall, and which takes in the air that has been discharged from said screw type pump air transfer portion; and an air outlet having an air circulation groove which is formed as rings by a larger diameter cylindrical wall and a smaller diameter cylindrical wall each connected to each of said larger diameter cylindrical wall and said smaller diameter cylindrical wall of said air outlet space, respectively, and which discharges air while circulating it, and a tangential air outlet extending toward the tangents of said larger diameter cylindrical wall and is connected to a downstream edge of said air circulation groove.

20. The multiple-type vacuum pump as recited in claim 19, wherein said air circulation groove has a spiral-formed base, and performs air exhaust along the spiral base.

* * * * *